US007465114B2

(12) United States Patent
Kress et al.

(10) Patent No.: US 7,465,114 B2
(45) Date of Patent: Dec. 16, 2008

(54) VIBRATING MASCARA APPLICATOR, SUITABLE COMPOSITIONS AND METHOD OF USE

(75) Inventors: George H. Kress, Fanwood, NJ (US); Paul H. Marotta, Farmingdale, NY (US); Daniela T. Bratescu, Northport, NY (US)

(73) Assignee: Elc Management LLC, New York, NY (US)

( * ) Notice: Subject to any disclaimer, the term of this patent is extended or adjusted under 35 U.S.C. 154(b) by 587 days.

(21) Appl. No.: 11/154,623

(22) Filed: Jun. 16, 2005

(65) Prior Publication Data

US 2006/0032512 A1 Feb. 16, 2006

Related U.S. Application Data

(60) Provisional application No. 60/600,452, filed on Aug. 11, 2004.

(51) Int. Cl.
*A46B 11/00* (2006.01)
*A46B 13/00* (2006.01)

(52) U.S. Cl. ..... 401/129; 401/126; 15/22.1

(58) Field of Classification Search ..... 401/126, 401/129; 15/22.1; 132/218
See application file for complete search history.

(56) References Cited

U.S. PATENT DOCUMENTS

| | | | |
|---|---|---|---|
| 3,030,647 | A | 4/1962 | Peyron |
| 3,033,197 | A | 5/1962 | Barckley |
| 3,383,157 | A | 5/1968 | Goldhirsh |
| 3,384,095 | A | 5/1968 | Shih |
| 3,794,050 | A | 2/1974 | Gallanis et al. |
| 3,892,997 | A | 7/1975 | Thorington et al. |
| 3,998,235 | A | 12/1976 | Kingsford |
| 4,011,616 | A | 3/1977 | Kennedy |
| 4,056,111 | A | 11/1977 | Mantelet |
| 4,236,314 | A | 12/1980 | Schmidt et al. |
| 4,397,326 | A | 8/1983 | Formica |
| 4,545,393 | A | 10/1985 | Gueret et al. |
| 4,586,520 | A | 5/1986 | Brittain |
| 4,632,136 | A | 12/1986 | Kingsford |
| 4,733,425 | A | 3/1988 | Hartel et al. |
| 4,861,179 | A | 8/1989 | Schrepf et al. |
| 4,887,622 | A | 12/1989 | Gueret |

(Continued)

FOREIGN PATENT DOCUMENTS

| | | | |
|---|---|---|---|
| DE | 8603383 | U1 | 9/1986 |

(Continued)

OTHER PUBLICATIONS

Risdon/ Elizabeth Arden Advertisment http://crownrisdon.com/products/eyecare.htm Accessed Feb. 18, 2005.

*Primary Examiner*—David J Walczak
(74) *Attorney, Agent, or Firm*—Peter M. Giancana

(57) ABSTRACT

A mascara applicator with vibrating applicator head. The head is caused to vibrate in a controlled manner through electro-mechanical urging. The frequency, amplitude and geometry of the vibrating head are sufficient to significantly alter the rheological properties of thixotropic and anti-thixotropic mascara compositions, including an effect that persists after the vibration has stopped. The device allows the mascara to be manipulated for improved results, greater flexibility in formulation, benefits in manufacture, as well as other benefits.

28 Claims, 8 Drawing Sheets

U.S. PATENT DOCUMENTS

| | | | | |
|---|---|---|---|---|
| 4,914,988 | A | 4/1990 | Chang | |
| 4,922,934 | A | 5/1990 | Gatti | |
| 4,993,440 | A | 2/1991 | Gueret | |
| 5,094,254 | A | 3/1992 | Krueckel et al. | |
| 5,107,870 | A * | 4/1992 | Beck et al. | 401/129 |
| 5,137,038 | A | 8/1992 | Kingsford | |
| 5,180,241 | A * | 1/1993 | Gueret | 401/122 |
| 5,187,827 | A | 2/1993 | Wei | |
| 5,229,354 | A | 7/1993 | Narayanan et al. | |
| 5,238,011 | A | 8/1993 | Gueret | |
| 5,341,534 | A | 8/1994 | Serbinski et al. | |
| 5,345,644 | A | 9/1994 | Gueret | |
| 5,357,987 | A | 10/1994 | Schrepf | |
| 5,476,384 | A | 12/1995 | Giuliani et al. | |
| 5,492,136 | A | 2/1996 | Edmonds | |
| 5,567,072 | A | 10/1996 | Dunleavy et al. | |
| 5,595,198 | A | 1/1997 | Kemmerer | |
| 5,717,760 | A | 2/1998 | Satterfield | |
| 5,816,728 | A | 10/1998 | Nardolillo et al. | |
| 5,860,423 | A | 1/1999 | Thompson | |
| 5,937,871 | A | 8/1999 | Clay | |
| 5,967,105 | A | 10/1999 | Freeland | |
| 6,009,884 | A * | 1/2000 | Suh | 132/217 |
| 6,139,553 | A | 10/2000 | Dotan | |
| 6,142,692 | A | 11/2000 | Garcia | |
| 6,145,514 | A | 11/2000 | Clay | |
| 6,178,579 | B1 | 1/2001 | Blaustein et al. | |
| 6,237,609 | B1 | 5/2001 | Vasas | |
| 6,345,626 | B1 | 2/2002 | Bouix | |
| 6,450,178 | B1 | 9/2002 | Clay | |
| 6,481,104 | B1 | 11/2002 | Parker et al. | |
| 6,565,276 | B1 | 5/2003 | Diaz | |
| 6,691,716 | B2 | 2/2004 | Neuner et al. | |
| 6,811,340 | B2 | 11/2004 | Petit | |
| 2002/0116774 | A1 | 8/2002 | Forrest | |
| 2002/0168214 | A1 | 11/2002 | Carullo et al. | |
| 2004/0234323 | A1 | 11/2004 | Albisetti et al. | |
| 2004/0240926 | A1 * | 12/2004 | Gueret | 401/122 |
| 2006/0032053 | A1 | 2/2006 | Saker et al. | |
| 2006/0032054 | A1 | 2/2006 | Simms et al. | |
| 2006/0032055 | A1 | 2/2006 | Simms et al. | |
| 2006/0037197 | A1 | 2/2006 | Hawes et al. | |
| 2006/0272666 | A1 | 12/2006 | Wyatt et al. | |
| 2006/0272667 | A1 | 12/2006 | Wyatt et al. | |
| 2006/0272668 | A1 | 12/2006 | Wyatt et al. | |

FOREIGN PATENT DOCUMENTS

| | | |
|---|---|---|
| DE | 19950665 | 5/2000 |
| DE | 20210482 U1 | 10/2002 |
| EP | 0511842 | 11/1992 |
| EP | 1563760 | 8/2005 |
| FR | 2848790 | 6/2004 |
| GB | 846639 | 8/1960 |
| JP | 96-289815 | 11/1996 |
| JP | 2005-095531 | 4/2005 |
| WO | WO02-072042 | 9/2002 |
| WO | WO2006-090343 | 8/2006 |

* cited by examiner

VIBRATING MASCARA APPLICATOR, SUITABLE COMPOSITIONS AND METHOD OF USE

The following invention claims priority under 35 USC 119e of U.S. provisional application 60/600,452 filed Aug. 11, 2004.

INTRODUCTION

The present invention pertains to mascara applicators and compositions for use therewith. Specifically, the present invention relates to mascara applicators that vibrate in a controlled manner and the use of such applicators with thixotropic and anti-thixotropic compositions. The frequency and amplitude of the vibration are sufficient to significantly alter the viscosity of a mascara in a controlled manner, thus allowing the mascara to be manipulated at the time of use, for improved results. The combination of a vibrating applicator and methods for using such with thixotropic or anti-thixotropic compositions leads to benefits in the field of mascara application, formulation and manufacture.

BACKGROUND

Mascara products are very popular. Today, the best selling mascara products have department store sales between one and five million dollars per year in the United States alone. Because of this, significant resources are devoted to the development of innovative mascara products. Innovative mascara products are those that introduce new features to the consumer or that improve upon exiting mascaras by making them perform better or by making them less expensive. Innovation in mascara products may occur in the composition or in the applicator used to apply the composition. Being innovative in the field of mascara products can be a challenge because mascara compositions are one of the most difficult cosmetics to formulate, package and apply. In part, this is owing to the physical and rheological nature of the product. Mascara is a heavy, viscous, sticky and often messy product. It does not flow easily in manufacture, filling or application, while drying out quickly at ambient conditions. It may contain volatile components that make safety in manufacture an issue. Mascara is also difficult because of the target area of application. The eyelashes offer a very small application area, while being soft, flexible, delicate and in close proximity to very sensitive eye tissue. Being flexible, the eyelashes yield easily under the pressure of a mascara applicator which makes transfer of the product onto the lashes difficult. The act of transferring a rheologically difficult product to a small, delicate target and in so doing achieve specific visual effects, is the challenging task of mascara application. Furthermore, mascara is unlike most cosmetic products because more than most cosmetics, the success of a mascara product depends on using the product with the right applicator. The overall consumer experience depends on both the product and on the applicator used to apply the it. A well executed mascara formulation may prove to be a failure in the marketplace if not sold with the right applicator to apply and work the mascara on the lashes to achieve the desired effect. Taken the other way, not every mascara composition is right for every kind of mascara applicator. Therefore, a mascara product that is sold with an otherwise commercially popular applicator, may not be well received by the consuming public, if the mascara composition does not complement the applicator function. For this reason, early in development, mascara formulators should and do consider what type of applicator will best complement their composition. However, to date, applicants are unaware of any disclosure concerning which rheological type of mascara compositions will work better with which types of applicator. By "work better" it is meant that one or more art-recognized properties of mascara application is improved by choosing a particular kind of mascara for use with a particular kind of applicator compared to the same mascara with some other applicator or a rheologically different mascara with the same applicator. "Rheological type" and "rheologically different" mean thixotropic verses anti-thixotropic.

The most common mascara applicator is the mascara brush. A typical mascara brush comprises a core, bristles, a stem and a handle. The core is typically a pair of parallel wire segments formed from a single metallic wire that has been folded into a u-shape. Bristles, usually comprised of strands of nylon, are disposed between a portion of a length of the wire segments. The wire segments, with the bristles disposed therebetween, are twisted or rotated about each other to form a semi-rigid helical core, also known as a twisted wire core. The twisted core holds the bristles substantially at their midpoints so as to firmly clamp them. In this state, the bristles, which are secured in the twisted wire core, extend radially from the core in a helical or spiral manner. Collectively, the radially extending bristles form a bristle portion or bristle head. The imaginary surface of the bristle head, comprising all of the bristle tips, is known as the bristle envelope. Many variations of this brush are known in the art. Although the results of mascara application and customer satisfaction depend on the combination of product and brush, it is useful to separately discuss the performance of each.

Mascara Brushes: Characteristics and Performance

An ideal mascara brush may be thought of as one that performs certain functions. These include taking up, in one step, enough product from the mascara reservoir to coat all the lashes of one eye, without having to re-insert the brush into the reservoir. The act of repeatedly reinserting the brush into the reservoir has the effect of incorporating air into the mascara in the reservoir, which causes the mascara to dry out and become unusable faster than it otherwise would. Further, the ideal brush must transfer to the lash enough product to coat the entire lash. That is, having withdrawn from the reservoir an optimal amount of product, the ideal brush must now be able to transfer that product to the lashes. To some degree, the ability of the applicator to take up product from the reservoir and the ability to give off that product to the eyelashes work against each other. In the first instance it is desirable for mascara to stick to the brush so that it can be removed from the reservoir. In the second instance it is desirable for the mascara to unstick from the brush so that it may cling to the lashes. Having deposited the product on the lash, the ideal brush evenly distributes the product over all the lashes. Further, the ideal brush smoothes out any clumps of product which may have been drawn from the reservoir and placed on the lashes. The ideal brush is able to separate and comb out the lashes to give the lashes a clean, well groomed, finished appearance. The ideal brush can be used effectively to touch up or doctor the lashes as needed. Also, a brush that evacuates substantially all of the mascara product from the reservoir is ideal. To date, a single brush that performs all of these functions optimally is believed not to exist. This is because different bristle types and configurations are better or worse at one or more functions. Therefore, a typical mascara brush represents a trade-off between maximizing some brush functions at the expense of others. The finally selected brush depends on the nature of the mascara product with which it is to be used. For example, a mascara formulated to give volume to the lashes should ideally be sold with a brush suitable for that purpose.

The current state of mascara brush art is such that some parameters known to affect various brush functions have been identified. Generally, the values of these parameters cannot be adjusted to produce an ideal brush, that is, a brush that performs all the desired functions satisfactorily. Because of this trade-off situation, there exist a great number of variations of the typical mascara brush. Some brushes seek to maximize some functions at the expense of others, while other brushes attempt to split the difference, so to speak, by performing many functions somewhat satisfactorily. Arriving at these variations is frequently no more than selecting appropriate values for the various known parameters. A review of those parameters that are recognized by a person of ordinary skill in the art to be results-effective is in order.

The shape of the wire core. While a straight core is still the most common in the cosmetics marketplace, bent wire cores are also known. For example, a core in the shape of an arc that attempts to match the shape of the eyelid are known (U.S. Pat. No. 5,137,038, U.S. Pat. No. 5,860,432 and U.S. Pat. No. 6,237,609). This shape, it is supposed, may be more efficient at coating the lashes. In U.S. Pat. No. 5,761,760 the wire core is bent to form a closed loop. The purpose of the loop is to provide a reservoir for retaining and transferring mascara or other pasty product from the mascara container to the eyelashes. Because this brush applies a relatively large dose of mascara, it is suitable for increasing length and volume of the lashes. It may be less suitable for combing, declumping and separating the lashes.

Stiff verses flexible bristles. It is generally recognized in the art that stiffer bristles are better than more flexible bristles when it comes to loading the brush with mascara from the reservoir. Stiffer bristles are thought to retrieve more product from the reservoir than do more flexible bristles. As the brush is withdrawn from the reservoir it passes through a wiper one function of which is to spread the product as evenly as possible over the surfaces of the bristles to provide a neater brush. In this way, portions of the brush with relatively high concentrations of product may be thinned out and some portions with relatively little product may be loaded. Generally, bristles that are too flexible will become matted down upon passing through the wiper and thereafter may remain stuck together because mascara is typically quite tacky. Having been removed from the reservoir, the loaded brush is made to contact the eyelashes. At this point, it is generally understood that a brush with softer, more flexible bristles in a dense array is better for transferring the mascara to the eyelashes by affecting as much transfer as possible. Once the eyelashes are loaded, however, it is generally understood that an applicator brush having stiffer bristles and a relatively open bristle envelope or sparse array (so as to be more comb-like) is needed to declump the product and separate the lashes. Given this situation, various attempts have been made to provide a mascara brush that combines the benefits of both stiff and flexible bristles. For example, a brush that is said to provide good application and combing characteristics is shown in U.S. Pat. No. 4,861,179. Disclosed is a brush having a combination of conventional soft bristles and conventional stiff bristles. Another example of a brush said to provide good application and combing characteristics is shown in U.S. Pat. No. 5,238,011 which discloses bristles made of a soft material having a shore hardness of 20A to 40D (a conventional bristle typically has a durometer of over 85D), and a large diameter in a range of 3.9 to 13.8 mil (10 to 35 hundredths of a millimeter), which is at least 1.5 mil (~4 hundredths of a millimeter) wider than a typical soft polyamide bristle. In this patent, the diameter is said to be sufficiently large to prevent too high a degree of suppleness. The resulting brush is said to have the same degree of suppleness or softness as a conventionally softer brush. Accordingly, the bristles are equivalent in stiffness to conventional bristles.

While these references may disclose brushes suitable for the application and combing of conventional mascara, currently preferred mascaras have significantly higher resting viscosity (two million CPS and above). These higher viscosity mascaras tend to collapse bristles of conventional stiffness, thus rendering a brush having bristles of conventional stiffness ineffective for purposes of application or combing. Accordingly, some of the forgoing brushes would not be suitable for use with such higher viscosity mascaras. Furthermore, these brushes do not offer the user the opportunity to compensate, at will, for one or the other shortcoming (i.e. bristles too soft or too stiff). Once these brushes leave the factory, they are what they are and cannot be altered by the user.

Bristle length and density. As a general rule, longer and more densely spaced bristles retrieve more product from the reservoir and deposit a thicker coating of mascara on the lashes than shorter, less densely spaced bristles. This is simply because in the former case there is more surface area on which to accumulate mascara. However, one problem with densely spaced bristles that carry a large quantity of mascara is that the lashes may not be able to penetrate the space between the bristles. This is simply because the lashes are so flexible. Also, because densely spaced bristles carry a lot of product from the reservoir while tending not to separate the lashes, there is a tendency for the lashes to clump together during application. With such a brush, it is not easy to obtain an even coat on the lashes. A lot of brushing, effort, skill and patience on the part of the user is required. In contrast, a brush with less densely spaced bristles may penetrate the lashes easily, but delivers less product, perhaps an insufficient coating to the lashes. To overcome this, the procedure must be repeated multiple times for each lash. It is generally understood in the art, that the more times the making up procedure is repeated, the more chance there is to mess up the entire application of mascara. The longer it takes to perform the application, the more complicated it becomes. If the product already applied to the lashes is setting up and drying out while new mascara is still being applied over it, an even, clean appearance may be very difficult to achieve. It may become necessary to clean the eyelashes and start again. Mascara application is known to be a bit of a skill and a bit of an art, wherein less is sometimes more.

U.S. Pat. No. 4,887,622 discloses a low density mascara brush, the bristles of which are spaced from 10 to 40 bristles per turn of the twisted wire core. As discussed in the '622 patent, then-conventional brushes had about 50 to 60 bristles per turn with the per-turn pitch being about 2 mm and the bristle diameter being about 0.08 mm maximum. It is alleged that 50-60 bristles per turn is sufficient to take up enough mascara to coat the lashes, but that brushes of this bristle density do not distribute the product very well, resulting in blobs of product and wasted time. The alleged improvement consists of reducing the bristles per turn to 10-40 while using bristles of a larger diameter (0.10 to 0.25 mm). Though there are fewer bristles to carry product, more product may carried by each bristle. The lower density permits the bristles to penetrate the lashes and provide an even coat of product.

Mixing bristle types. U.S. Pat. No. 4,586,520 disclose a mascara applicator whose brush contains alternating rows of long and short bristles. It is alleged that this arrangement of alternating rows of long and short bristles allows for easier application of mascara while simultaneously combing and separating the eyelashes. U.S. Pat. No. 5,345,644 discloses a mascara brush having two different types of bristles intermingled along the axis of the brush. One type is a smaller diameter (0.06-0.13 mm), higher melting point thermoplastic bristle, the other is a larger diameter (0.13-0.30 mm), lower melting point thermoplastic bristle. It is alleged that strong, distinct make-up effects are achieved with this type of brush.

Sectioning bristle types. U.S. Pat. No. 5,357,987 and EP 0511842 disclose mascara brushes having a bristle array with a discontinuous profile. There is a tip portion having one overall size and shape and a proximal portion having a second size and shape. The main reason for this is to provide a single brush in sections, each section of which is better than the other section at performing some application tasks.

U.S. Pat. No. 5,482,059 combines sectioning and mixed bristle types within one section. This patent discloses a mascara brush having three sections and three types of bristles. The brush portion has a larger diameter middle section comprised of a combination of soft and stiff bristles in random configuration, and two end sections comprised of hollow filaments which preferably become progressively shorter towards the ends of the brush portion. The end sections exhibit less bristle density than the middle section. This improved brush configuration allows for optimal one-stroke mascara application.

Shape of the envelope. The most conventional envelope shape is the tapered spiral or helical array of bristles. One variation on this theme is U.S. Pat. No. 5,595,198 in which a helical groove is present along the length of the bristle array due to the use of specifically positioned, shorter bristles. The groove is for carrying larger quantities of product than would otherwise be possible. A great many envelopes shapes have been introduced into the art, each purporting to be an improvement on one or more aspects of mascara application.

Bristle shape. U.S. Pat. No. 4,993,440 discloses the use of bristles having capillary channels along their length. U.S. Pat. No. 5,567,072 discloses bristles with a slotted cross sectional configuration. U.S. Pat. No. 5,595,198 discloses bristles with an L-shaped cross section. Tubular bristles are disclosed in U.S. Pat. No. 4,733,425.

Other applicator features. Mascara applicators that are said to have performance enhancing features apart from the applicator head, are known. Ergonomic handles and comfort grips are known. U.S. patent publication 2002-0168214 discloses a mascara handle grip made from one or more deformable elastomers and having a dual-tapered portion such that two tapered sections meet at a narrowest point along the dual-tapered portion, and wherein the cross section of one or both tapered sections is elliptical. The use of this or any other deformable grip on a vibrating mascara applicator system is unknown to the applicant.

Non conventional mascara applicators. In the quest for the ideal mascara applicator some have avoided the issue of stiff verses flexible bristles by not using bristles. U.S. Pat. No. 3,892,997 describes an applicator comprising a central shaft (or core) along the length of which rigid triangular plates outwardly project, many such plates being parallel to each other. The regularly spaced plates are reportedly suitable for loading, transferring, coating and separating. U.S. Pat. No. 4,545,393 described a bellows capable of being lengthened or shortened by the user as required. The stacked "teeth" of the bellows provide surfaces for holding mascara and the spacing between the teeth allows the eyelashes to be coated and separated. U.S. Pat. No. 5,094,254 describes a central core with a ribbed profile. The individual ribs provide surfaces for holding mascara and the spacing between the ribs allows the eyelashes to be coated and separated. U.S. Pat. No. 5,816,728 describes a beaded mascara applicator, that is a mascara applicator having one or more beads disposed on a central axle extending longitudinally from an elongated rod and handle. A first preferred embodiment comprises a single cylindrical bead molded from plastic and having a series of longitudinally spaced grooves along the length of the bead. A second preferred embodiment comprises a plurality of about 5 to 7 beads disposed on a metal axle and retained by means of a flat-headed pin. The beads are capable of individually or collectively rotating about the axle to create optimal mascara application and lash separation. U.S. Pat. Nos. 6,345,626 and 6,691,716 disclose a mascara applicator having an array of independent discs which compress during withdrawal from a container so that excess product can be removed from the applicator by a wiper. After passage through the wiper, the discs return to their expanded position by the action of a spring. The compressing of the discs during withdrawal allows a controlled amount of product to remain on the applicator for application by the consumer, and the returning of the discs to their expanded position by the spring causes the discs to assume a configuration which allows the applicator to effectively comb and separate the eyelashes.

As can be seen from the foregoing brief survey of the mascara applicator field, many innovations and proposals have been put forward. None of these proposals deal with substantially, measurably altering the flow characteristics of a mascara product at the time of application. Nothing in the prior art anticipates or suggests a vibrating mascara applicator capable of altering the viscosity of a mascara in a controlled fashion, nor the benefits of such. To the best of the applicant's knowledge, a brush that offers to the user the opportunity to alter the performance of both the applicator and mascara at the time of application, is unknown in the art. Simultaneously, it will be appreciated from the discussion to follow, that any of the mascara applicators heretofore described, indeed virtually any mascara applicator, would assume additional performance advantages if the such were made to vibrate in the manner herein described.

Rotating Mascara Brushes. Mascara brushes that rotate during application are known. Rotation occurs around the long axis of the applicator rod, a motion that is unlike the vibrating applicator of the present invention. U.S. Pat. No. 4,056,111 describes a motor-driven, rotatable mascara brush. The motor may comprise a rewindable spiral spring (i.e. a clock-work motor) or a battery powered motor may be used. U.S. Pat. No. 6,565,276 discloses a battery powered motor, rotating mascara brush head. In either case, the brush can be made to rotate in either direction to accommodate left and right handed operation for either eye. The stated advantage is convenience and less movement required by the user. U.S. Pat. No. 4,397,326 describes a non-motorized mascara brush, the head of which is free to rotate and does so when the brush head contacts the eyelashes during application. It is the act of brushing that causes the rotation. It is claimed that the rotation of the brush head allows more mascara to be deposited on the lashes in a single application than other wise would be possible. U.S. Pat. No. 4,632,136 describes a rotating brush applicator for mascaras having a viscosity range from 1,500 to 25,000 poise at ambient temperatures. The brush has 75-150 bristles per quarter inch and a motor housed in the handle of the applicator turns the brush. These parameters were chosen to allow the bristles of a rotating brush loaded with mascara to penetrate and move though the lashes. The author noted that rotating brushes cannot not penetrate the eyelashes when used with formulae more viscous than 25,000 poise and/or bristle arrangements more dense than 150 bristles per quarter inch. In that case, the rotating brush only bends the lashes back as it presses against them. Also, it is explicitly disclosed that the brush is not made to rotate until after the brush is removed from the reservoir. No shearing of the product takes place in the reservoir because the purpose of the rotating brush is not to shear the product, it is to separate and comb the lashes. Because of this, the invention was limited to a range of mascara viscosity and less dense bristle arrangement. Also, no motor or drive mechanism are disclosed for affecting the brush rotation and no frequency is disclosed. JP 2005-095531 discloses an electric motor that operates a gear that rotates a brush head at fixed speed. The rotation occurs around the long axis of the applicator rod. At the time of filing this application, only an abstract of JP 2005-095531 is available to the applicant. No further details or alleged benefits are known at this time.

These are unlike the present invention where the brush does not rotate about the axis of the brush, rather it oscillates laterally at relatively high speed, in the reservoir and out of the reservoir to shear the product and substantially alter the product's viscosity. None of these references disclose a mascara brush that vibrates or oscillates in a direction perpendicular to the long axis of the rod. None of these references disclose the mascara applicator with a brush head that vibrates while in the reservoir, as well as during application to the lashes. If further seems questionable whether the clock-work motor (wind-up motor) of U.S. Pat. No. 4,056,111 and the "low speed" motor preferred in U.S. Pat. No. 6,565,276 would be able to rotate when the brush head is immersed in the viscous mascara product in the reservoir and therefore, whether they could shear the product in the reservoir to substantially alter its viscosity. Obviously, the non-motorized brush of the '326 patent cannot rotate when immersed in mascara, and therefore is unable to shear the product. In contrast, the oscillating or vibratory motion of the present invention is capable of substantially shearing a viscous mascara. The '111 and '276 brushes also require added complexity to effect the reversible motor feature, gears and pinions and such. The device of the JP '531 publication also has gears. In contrast, the motor of the present invention does not have gears nor need to be reversible in order for the motion of the brush head to be effective. The motor used in the present invention is, therefore, simpler. Furthermore, the present invention may be used over the whole range of mascara viscosities, not being limited as is the '136 brush. The lateral motion of a brush according to the present invention is thought to be superior to the '136 applicator regarding separating the lashes and preventing clumping. For example, the vibrating movement of the brush head naturally carries and pushes the mascara toward the baseline of the eyelash, where some users may be too squeamish to go. A brush rotating about the long axis of the rod does not provide this advantage.

Other electric brush devices. Electric toothbrushes are known. Despite their superficial similarity to motorized mascara brushes, the typical electric toothbrush also has a number of significant differences with them. These differences make a toothbrush ineffective for performing many of the functions of a mascara brush, as discussed above. Generally, toothbrush bristles have different stiffness requirements than those of a mascara brush, owing to their different purposes and areas of use. Also, toothbrush bristles are generally longer, as much as two to five times longer than mascara brush bristles. The toothbrush bristles are located only on one side of the head as opposed to generally surrounding the head. A toothbrush does not have a working tip at the distal end of the head as do most mascara brushes. The envelope of the toothbrush is a two dimensional plane rather than a three dimensional surface. Toothbrush bristles are generally more densely packed than those of a mascara brush and they are usually all the same length, unlike most mascara brushes which have varied length bristles. Toothbrush bristles are generally supported by a relatively large, flat base that is located at the exterior of the bristle array as opposed to the center of the bristle array. Such a base cannot fit into a common mascara tube and if it could it would become covered with mascara making a mess and wasting a lot of mascara. Owing to their many differences, mascara brushes and toothbrushes are generally patentably distinct.

Vibrating razors and dental flossers are also known. Generally, these may include a handle in which is located an electric motor, the operation of which produces a vibration. The similarities between these devices and that of the present invention end there. For obvious reasons a shaving razor and a dental flosser are wholly unsuitable for mascara application. U.S. Pat. No. 5,299,354 discloses a vibrating wet shave razor. The be effective for shaving, the frequency of the electric motor is disclosed as being 5000 to 6500 revolutions per minute. The amplitude of the vibrating blade that is effective for shaving is disclosed as 0.002 to 0.007 inches.

Application Habits. While there are many variations in the way mascara users apply the product, there is some consensus on the best methods for so doing. In "The Beauty Bible," (by Paula Begoun, 2nd ed., June 2002, Beginning Press, ISBN 1-877988-29-4), herein incorporated by reference in its entirety, the author recommends the following. "The traditional upper-lash application of rotating the mascara wand by round-brushing from the base of the lashes up to cover all the lashes around the entire eye is the most efficient, expedient method." The author further notes, "Apply mascara to the lower lashes by holding the wand perpendicular to the eye and parallel to the lashes (using the tip of the wand). This prevents you from getting mascara on the cheek. It also makes it easier to reach the lashes at both ends of the eye." Also, after applying the mascara in whatever manner, some women brush out the lashes with a separate brush or comb.

Mascara Compositions: Characteristics And Performance

Turning now, to mascara compositions, there is an established vocabulary for discussing their performance characteristics. Each of these characteristics can be evaluated and assigned a number on a random scale, from 0 to 10, say, for purposes of comparison during formulation. "Clumping", as a result of mascara application, is the aggregation of several lashes into a thick, rough-edged shaft. Clumping reduces individual lash definition and is generally not desirable. "Curl" is the degree to which a mascara causes upward arching of the lashes relative to the untreated lashes. Curl is often desirable. "Flaking" refers to pieces of mascara coming off the lashes after defined hours of wear. The better quality mascaras do not flake. "Fullness" depends on the volume of the lashes and the space the between them, where "sparse" (or less full) means there are relatively fewer lashes and relatively larger separation between the lashes and "dense" (or more full) means the lashes are tightly packed with little measurable space between adjacent lashes. "Length" is the dimension of the lash from the free tip to its point of insertion in the skin. Increasing length is frequently a goal of mascara application. "Separation" is the non-aggregation of lashes so that each individual lash is well defined. Good separation is one of the desired effects of mascara application. "Smudging" is the propensity for mascara to smear after defined hours of wear, when contacting the skin or other surface. Smearing is facilitated by the mascara mixing with moisture and/or oil from the skin or environment. "Spiking" is the tendency for the tips of individual lashes to fuse, creating a triangular shaped cluster, usually undesirable. "Thickness" is the diameter of an individual lash, which may be altered in appearance by the application of mascara. Increasing thickness is usually a goal of mascara application. "Wear" is the visual impact of a mascara on the lashes after defined hours as compared to immediately after application. "Overall look" is one overall score that factors in all the above definitions. It is a subjective judgment comparing treated and untreated lashes or comparing the aesthetic appeal of one mascara to another. The ideal mascara will possess all of the desirable properties while avoiding the undesirable.

Often, the formulator is interested in achieving thicker, fuller, well separated lashes. Characteristics like clumping and spiking tend to work against this, and a developer can improve one or more characteristics only at the expense of others. For example, to increase the fullness of a particular mascara, conventional wisdom suggests adding more solids (wax) to the composition. However, a disadvantage of doing this is that it tends to increase clumping of the composition and decrease the user's ability to separate the lashes. A high level of solids can also create a negative sensorial effect because the high concentration of solids makes the mascara difficult to spread over the lashes. The result can be tugging on the lashes, discomfort associated therewith and a poor application. The art of conventional mascara formulation is a balancing act between separation and volumizing, between too much of one and not enough of the other. One of the advantages of the present invention is that the definitions of "too much" and "not enough" are expanded beyond what has been achievable up to now. This increased formulation flexibility has advantages for the formulator, the manufacturer and the consumer.

Conventional mascara formulations include oil-in-water emulsion mascaras which may typically have an oil phase to water ratio of 1:7 to 1:3. These mascaras offer the benefits of good stability, wet application and easy removal with water, they are relatively inexpensive to make, a wide array of polymers may be used in them and they are compatible with most plastic packaging. On the down side, oil-in-water mascaras do not stand up well to exposure of water and humidity. Oil-in-water mascaras are typically comprised of emulsifiers, polymers, waxes, fillers, pigments and preservatives. Polymers behave as film formers and improve the wear of the mascara. Polymers affect the dry-time, rheology (i.e. viscosity), flexibility, flake-resistance and water-proofness of the mascara. Waxes also have a dramatic impact on the rheological properties of the mascara and will generally be chosen for their melt point characteristics and their viscosity. Inert fillers are sometimes used to control the viscosity of the formula and the volume and length of the lashes that may be achieved. Amongst pigments, black iron oxide is foremost in mascara formulation, while non-iron oxide pigments for achieving vibrant colors has also become important recently. Preservatives are virtually always required in saleable mascara products.

There are also water-in-oil mascaras whose principle benefit is water resistance and long wearability. These mascaras may typically have an oil phase to water ratio of 1:2 to 9:1. Various draw-backs of water-in-oil mascaras may include: difficulty in removing the product from the lashes, a long dry-time, a high degree of weight loss from the product reservoir, generally less compatibility with packaging materials than oil-in-water mascaras and a relatively low flash point. Water-in-oil mascaras are typically comprised of emulsifiers, solvents, polymers and pigments. Volatile solvents facilitate drying of the mascara. Polymers play a similar role in water-in-oil mascaras as in oil-in-water discussed above, although in the former, an oil miscible film forming polymer is recommended. The same classes of pigments may be used in water-in-oil mascaras, as in oil-in-water. Here though, a hydrophobically treated pigment may provide improved stability and compatibility.

Dry-out of mascara in the reservoir is a common problem. One way to limit dry-out is to provide mascara in cylindrical tubes or bottles that have a small cross sectional area, so that very little mascara contacts the ambient air. Nevertheless, often, some portion of the mascara in the reservoir becomes unusable because of dry-out. Dry-out may occur if too much water evaporates from the reservoir. The amount of evaporative water depends on the length of time the reservoir is exposed to the ambient air. Also, the act of repeatedly immersing the brush into the reservoir may incorporate air into the product, thus accelerating the rate of dry-out. Because of this, it is better to immerse the brush into the reservoir as few times as possible and the act of "pumping" the applicator to load product onto it should be avoided. In solvent-containing systems, dry-out occurs if too much solvent is allowed to volatize from the product. Ideally, the solvent would remain in the product until it is applied to the lashes and only then would the volatile component dissipate to create the drying effect. However, as typically happens, some solvent is lost from the product in the reservoir each time the product is exposed to the air. Therefore, normal use of the product causes the product to deteriorate. Frequently, what remains in the reservoir goes to waste, having dried out too much to be used.

Applicators for Altering the Viscosity at Time of Use

For the vast majority of mascara products on the market, no mechanism is provided to alter the rheological and application properties of the mascara at the time of application. In the literature, U.S. Pat. No. 5,180,241 describes a mascara container and conventional mascara brush wherein the container includes a helical spring on the inside of the container, through which the brush must pass on its way out of the container. The product on the brush is said to have its thixotropy broken by the action of the loaded bristles flexing and straightening as they squeeze through the turns of the spring. The reference does not quantify in any way to what degree the viscosity is affected nor how long the effect lasts. Disadvantages of this system include the fact that the mascara is only sheared for a moment while the brush is passing through the spring. There is no mechanism for longer, continuous shearing for an extended period of time, several seconds or minutes. There is no shearing after the brush is removed from the container, for example, while the mascara is being applied to the lashes. During this time, the viscosity, to the extent that it may have been reduced, is building back to its original value, so that the full, if any, advantage is not even realized. If a user attempts to increase the amount of shearing by repeatedly pumping the applicator through the spring, this will have the detrimental effect of incorporating air into the product and drying it out, as discussed above. This would actually produce a result opposite to that intended, causing the product to thicken ad flow less well. Also, in this reference there is no mention of mascaras that are capable of anti-thixotropic behavior (or thickening when sheared) and no suggestion of how this system may affect future mascara formulations. This is unlike the present invention wherein the viscosity is substantially, measurably altered by shearing, the duration of which is controllable by the user and which duration may be several seconds or minutes. Pumping the applicator is not necessary to cause shearing and anti-thixotropic mascaras can benefit from the present invention as well as thixotropic. Also, the present invention opens the way for changes in the way mascaras are conventionally formulated.

In U.S. Pat. No. 5,775,344, the mascara product is heated just prior to and/or during application. Generally, heat is supplied by a heating element powered by a battery. The heating element may be in the container that holds the mascara or in the brush that is dipped into the mascara. The '344 patent discloses cosmetic product devices that heat the entire contents of a reservoir prior to an application, each time this device is used. But it should be appreciated that not all mascaras can be temperature cycled without damaging the product. For mascaras that will be changed structurally or chemically by the application of too much heat or from being too often heated, these devices are wholly unsuitable. This is unlike the present invention, wherein the product remaining in the reservoir is not heated and remains in good condition for future use. Another disadvantage of these devices is the need for thermal insulation to keep the heat inside the reservoir. The insulation makes these devices more complex and costly than the present invention, wherein the reservoir is neither heated nor insulated.

Virtually all mascaras can, if shearing means are provided, exhibit some degree of thinning or thickening behavior. With a non-vibrating brush, a user cannot significantly shear a mascara to cause it to exhibit its thinning or thickening behavior. Even if some alteration of the product's viscosity did occur as a result of a conventional applicator shearing the product in the container, the amount would be insignificant as compared to the present invention and no significant advantage would accrue to the user. To the best of the applicant's knowledge, the fact that a mascara is capable of exhibiting thinning or thickening behavior has never been exploited to any significant degree in the application process. More specifically, the existence and use of a vibrating mascara brush to alter the viscosity of a mascara at the time of application are hitherto, unknown.

Objectives

Another object of the present invention is to provide a mascara applicator that vibrates, thus providing an improved mascara applicator and other advantages.

Another object of the present invention is to provide a mascara applicator that gives to the user an ability to alter the performance properties of the applicator at different stages of use.

Another object of the present invention is to provide a mascara applicator that gives to the user an ability to alter the performance properties of the mascara at different stages of use.

Another object is to provide a vibrating mascara applicator with disposable eyelash applicator head and reusable vibrating means.

Another object of the present invention is to provide a mascara applicator that more easily takes up product from the reservoir.

Another object of the present invention is to provide a mascara applicator that more completely evacuates the reservoir.

Another object of the present invention is to provide a mascara applicator that reduces the viscosity of the product just prior to and/or during application.

Another object of the present invention is to provide an improved mascara applicator that is effective for applying highly viscous mascaras.

Another objective is to provide mascara compositions that are suitable for use with a vibrating brush even though the compositions are unsuitable for use with a non-vibrating brush due to the compositions' rheological properties.

Another objective is to provide a mascara applicator that is capable of shearing a mascara such that after the shearing has stopped, a measurable effect on viscosity persists for a known time.

Another objective of the present invention is to improve mascara application by providing a method of formulating mascara compositions that are suitable for use with a vibrating applicator.

The foregoing objectives and other benefits may be realized by mascara compositions whose viscosity is predictably altered at the time of use by a vibrating applicator. Other objects of the invention and the advantages of it will be clear from reading the description to follow.

SUMMARY

The present invention is a cosmetic applicator having a vibrating applicator head. Compositions for use in the present invention are those that behave predictably in response to being vibrated by the vibrating applicator. Specifically, compositions of the present invention include those that behave thixotropically or anti-thixotropically in standard rheometric flow tests. The ability to manage the viscosity of the composition at the time of application, significantly enhances the types of formulations that may be offered to consumers and offers benefits in manufacture and cost of production.

DETAILED DESCRIPTION

Throughout this specification, the terms "comprise," "comprises," "comprising" and the like shall consistently mean that a collection of objects is not limited to those objects specifically recited.

The present invention is a mascara applicator having a vibrating applicator head. This broad concept is applicable to an unlimited range of mascara applicator types, as well as to cosmetic and personal care applicators and grooming tools in general. For simplicity, the starting point for this discussion is a typical mascara brush applicator, as described above. However, in principle, with the benefit of this disclosure, a person of ordinary skill in the art can apply the teachings of this disclosure to virtually any type of mascara applicator. Therefore, the applicator head is not limited to being a bristle head and may be any other type of mascara applicator head, such as the disc array described above.

The Applicator

Figure 1:
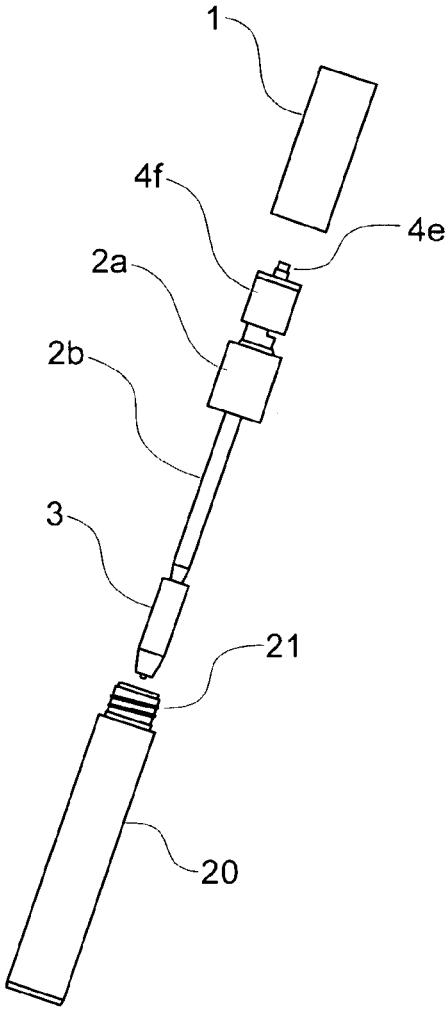
FIG. 1 is a perspective view of one embodiment of the present invention, shown with the handle disassembled from the stem and motor housing.
Figure 2:
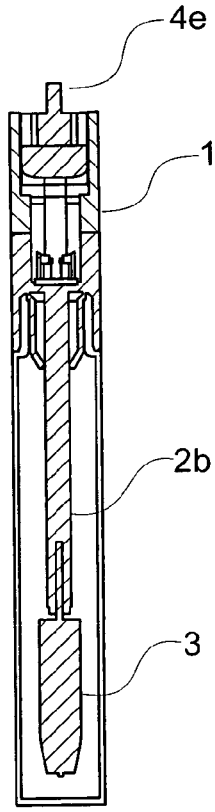
FIG. 2 is a cross section of one embodiment of the present invention.

With the above in mind, a basic mascara applicator according to the present invention (FIGS. 1 and 2) comprises a handle 1, a stem 2*a* attached to the handle, a rod 2*b* attached at its proximal end to the stem and extending beyond the handle, an eyelash applicator head 3 attached to the distal end of the rod, and means that cause the applicator head to vibrate. Here, "eyelash applicator head" means any configuration recognized in the cosmetics field as being suitable for making up or grooming the eyelashes, the most common of these being a bristle brush head, others having been described above. The vibrating means includes supplying one or more vibratory influences directly or indirectly to the bristle head. By "directly" it is meant that one or more vibratory influences are supplied to the bristle head without having to travel first through the other parts of the applicator, i.e. the handle or rod, etc. By "indirectly" it is meant that one or more vibratory influences are supplied to a portion of the applicator other than the bristle head and subsequently, one or more vibratory influences travels to the bristle head, arriving there with sufficient energy to be effective for the intended purpose. Either way, the type of motion executed by the vibrating bristles is different from that of the rotating brushes described above. With those brushes, the entire bristle envelope rotates about the long axis of the rod and no flexing of the rod occurs. In the present invention, the bristle envelope may not rotate. Depending on the design of the brush and the location and parameters of the vibrating means, either each individual bristle flexes from its point of insertion in the core or the rod flexes in a direction essentially perpendicular to its length, or both. The flexing of the rod may be a simple lateral flexion or side-to-side motion or the tip of the applicator may trace out a curvilinear path, for example an ellipse. Of course, as the rod flexes, the bristles are carried along in this motion.

Figure 3:
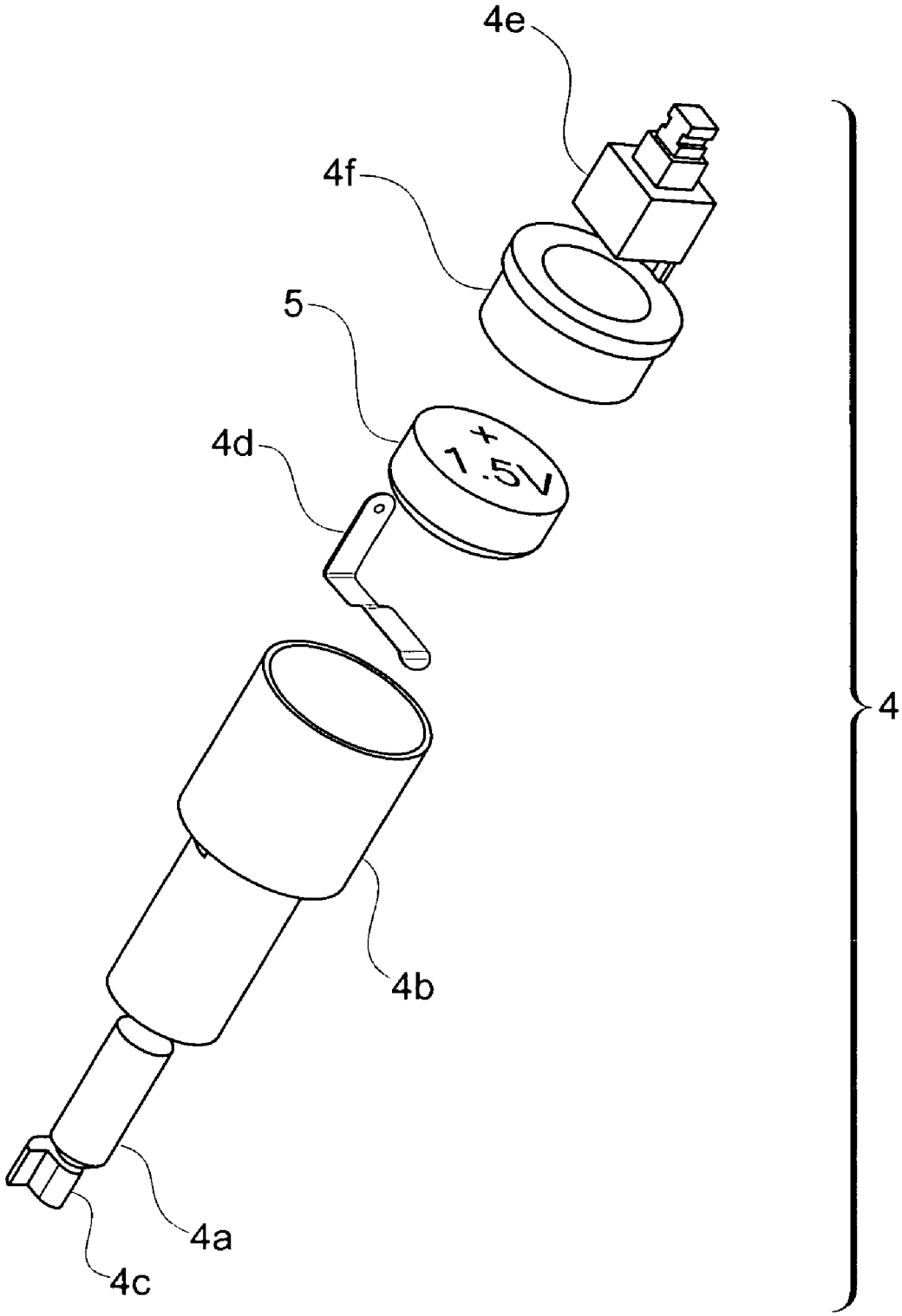
FIG. 3 is an exploded view of the motor housing and power supply.
Figure 4:
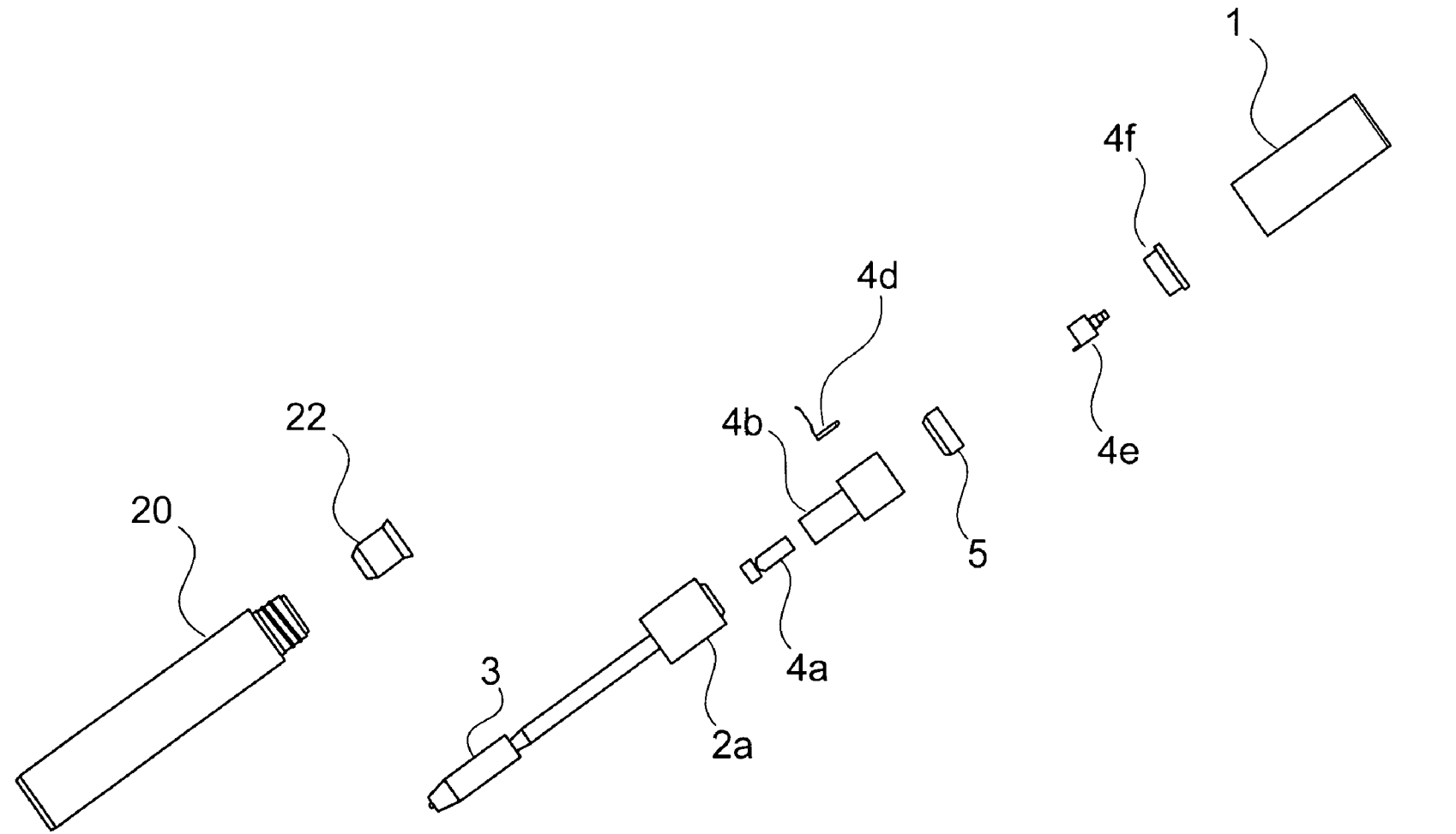
FIG. 4 is an exploded view of one embodiment of the present invention.
Figure 5:
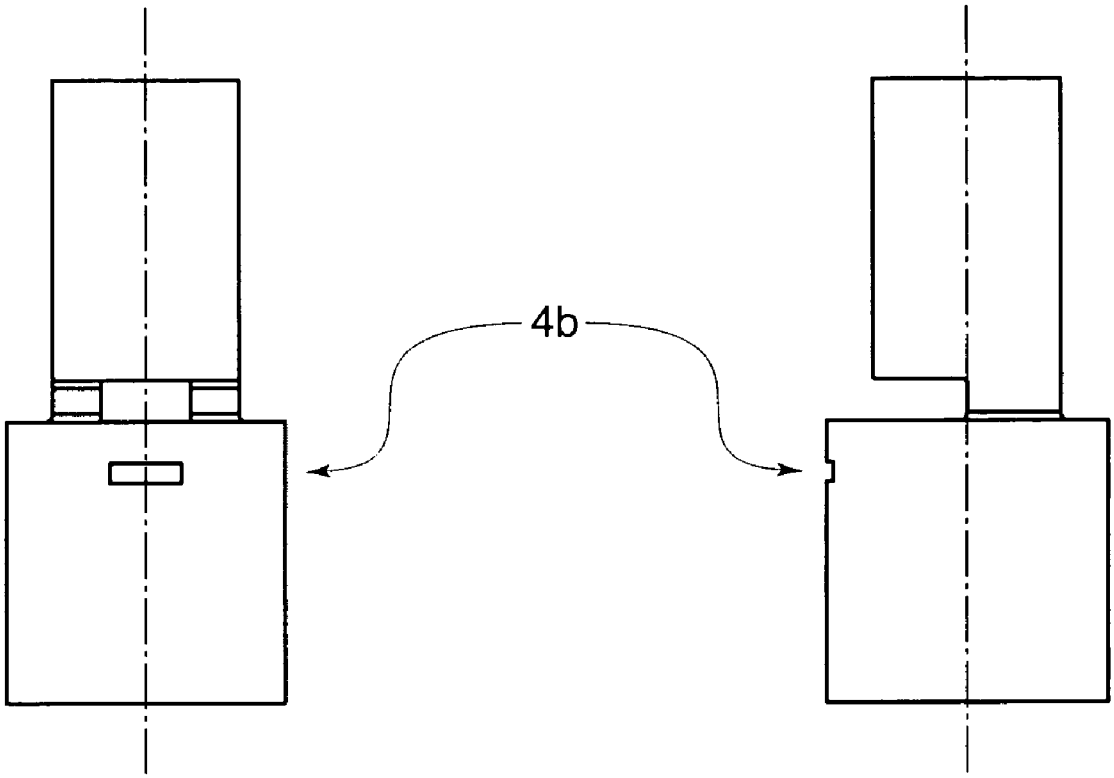
FIG. 5 is a front and side elevation of one embodiment of the motor housing.

In one embodiment of the present invention (see FIG. 3), a mascara applicator further comprises a DC motor subassembly 4 that is conveniently housed in the handle 1 of the mascara applicator, where it is hidden from view. The subassembly comprises a motor 4*a* and a motor housing 4*b*. The motor housing secures the motor and other parts inside the handle. A simple DC motor as used in the preferred embodiment of the present invention comprises six parts. These are: the armature (or rotor), the commutator, brushes, an axle, a field magnet and electrical leads. The relationships and workings of these parts in a DC motor are well known. In order to generate a vibratory influence, the center of mass of the axle is offset from the longitudinal axis of the axle. That is, the axle is weighted more heavily on one side of the axis of rotation than the other. Thus, when the axle rotates, a vibration is produced which travels out of the motor housing and into the handle of the mascara applicator. To this end, the axle may fitted with an eccentric counterweight 4*c* as shown in FIG. 3. Motors of this type may be found in pagers and cell phones that vibrate. In terms of size, "miniature motors" or "vibration motors" suitable for use in the present invention are commercially available from many sources. The amplitude of the vibration produced by the motor is determined, at least in part, by the speed of the motor, the mass of the eccentric counterweight and its degree of offset from the longitudinal axis of the axle. The amplitude of vibration of the applicator head further depends on the distance from the motor to the applicator head and on the physical properties, geometry and connections of the materials through which the vibration must propagate from the motor to the applicator head. A careful selection of these parameters will yield a desired frequency and amplitude of the oscillating applicator head. Optionally, a more sophisticated motor may be used. For example, a mascara applicator according to the present invention may comprise a motor that changes speeds, either stepwise or continuously at the discretion of the user.

In the embodiment of FIG. 3 the present invention further comprises a DC power supply 5, located in the motor housing and electrically connected to the motor to supply the motor with power. An electrical terminal 4*d* is also located in the housing, disposed between the power supply and the motor. In the preferred embodiment, the DC power supply is one or more batteries that, along with the motor housing, fit inside the handle of the applicator. Common household batteries, such as those used in flashlights and smoke detectors, selected to provide the motor with the proper current and voltage, are preferred. These typically include what are known as AA, AAA, C, D and 9 volt batteries. Other batteries that may be appropriate are those commonly found in cell phones, hearing aides, wrist watches and 35 mm cameras. The present invention is not limited by the type of chemistry used in the battery. Examples of battery chemistry include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries.

Other sources of DC current include solar based power, like solar cell technology, as found in many handheld devices, for example calculators and cell phones. According to this embodiment, one or more light collecting portions are located where sunlight or artificial light may shine on it. For example, the light collecting portions may be located on the outside surface of the handle, parallel to the axis of the handle. When light impinges the light collecting portions, the light energy is converted to electrical current for supplying the motor, via well known light cell technology. Optionally, a storage cell may be provided to store any unused electrical energy created by the photo cell, which may be later used to supply the motor, as for example when the lighting is too dim to create an adequate photo current for the motor.

In the preferred embodiment, the motor subassembly 4 and one or more batteries 5 are housed inside the handle 1 where they are hidden from view and protected from damage. However, there is nothing in principle that prevents the motor or any portion of it or the batteries from residing outside the handle or in some other part of the applicator. In principle, the only requirement is that the vibration produced by the motor is capable of traveling to the applicator head 3. This requirement may be met by establishing sufficient physical contact between the motor and the mascara applicator proper, such that a path exists for the propagation of vibrational energy from the motor to the brush head. As long as such a path exists, the vibrations produced in the motor will travel to the applicator head and cause the applicator head to vibrate.

Figure 6:
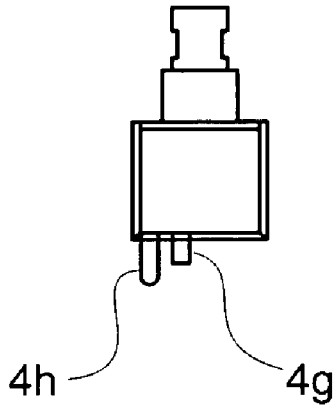
FIG. 6 is an elevation view of one embodiment of an electrical switch as may be used in the present invention.

An applicator according to the present invention, as for example, that of FIG. 3, further comprises at least one means for turning the motor 4*a* on and off. Generally, the on/off means is capable of alternately interrupting and re-establishing the flow of electricity between the motor and power source. In a preferred embodiment, at least one of the on/off means is one or more switches 4*e* accessible from the outside the applicator that can be engaged, either directly or indirectly, by a finger of the user. This type of on-off means will be referred to as "manual" in the specification. The switch, DC power supply and motor are electrically connected to form a closed circuit, in any manner well known in the electrical arts. Generally, a switch may comprise two electric leads. In FIG. 6 these are a battery contact 4*g* and a wire terminal 4*h*. The details of such switches are well known in the electrical arts and there are many suitable types. Some non-limiting examples include: toggle switches, rocker switches, sliders, buttons, rotating knobs, touch activation surfaces, magnetic switches and light activated switches. Also, multi-position switches or slider switches may be useful if the motor is capable of varying speeds.

In one embodiment a manual switch is located on the handle, either on the side wall or on the end of the handle and is directly accessible. In another embodiment, when the switch is located on the handle, a cap that fits over the button and secures to the handle may be provided. The cap (not shown) may serve to hide the button for aesthetic reasons or it may protect the button from being unintentionally switch on, while being carried in a purse, for example. In another embodiment, an indirectly accessible switch is located on the handle and covered by a deformable membrane, such that pressure applied to a portion of the membrane activates the switch. The embodiment of FIG. 3 also comprises a switch retainer 4*f* for securing the switch within the handle 1 in cooperative relationship with the power supply, motor and electrical leads of each.

In another embodiment, the motor 4*a* is automatically switched on and off. "Automatically switched" means that the motor is turned on or off as a result of a normal use of the applicator, other than specifically engaging a switch. For example, when the mascara applicator is drawn from the reservoir the motor may automatically turn on and then turn off when it is reinserted into the reservoir. In this embodiment, a switch is located in such a place on or within the applicator so that when the handle 1 is being separated from or attached to the reservoir 20 the state of the switch is changed. Generally, this will be achieved by providing a switch activator in a position such that as the handle is being separated from the reservoir the switch activator interacts with the switch to change the state of the switch. In one embodiment, this may be achieved by direct physical contact between the switch and the activator. For example, the switch may be a rocker switch positioned on the inside surface of the applicator handle 1 and the activator may be a projection located on or near the neck 21 of the reservoir. The relative position of each element is such that as the handle is unscrewed from neck of the reservoir, the rocker switch slides over the projection and the state of the rocker is changed from off to on. Later, as the handle is screwed onto the neck, the switch passes over the projection moving in the opposite direction and the state of the switch returns to off. In another embodiment a spring-loaded switch is located inside the handle, closer to the end of the handle that engages the reservoir 20. In this case, a top portion of the reservoir contacts the switch as the handle is being screwed onto the reservoir. When the handle is fully secured to the reservoir, then the switch is maintained in its off position. When the handle is unscrewed from the reservoir, the switch flips to the on position under the action of the spring. In another embodiment, some automatic switches work without direct physical contact between the switch and the activator. For example, the handle 1 may be provided with a magnetic contact on the outside handle surface and a corresponding magnetic contact may be located on the outside reservoir surface, in such a way that when the mascara applicator is in the closed position, the two magnetic contacts are adjacent. This type of electrical switch arrangement is common, for example, in home security systems on doors and windows. While the mascara applicator is closed and the contacts are in effectively close proximity, the switch is in the open position, i.e. current to the motor is interrupted. When the handle is withdrawn form the reservoir the magnetic contacts move apart so that the switch is closed and the motor is turned on. Later, when the handle is returned to the closed position on the reservoir, the magnetic contacts come into effective proximity again and the motor is turned off. Alternatively, the switch may be a photo or light activated switch, having one or more light collecting portions located where sunlight or artificial light may shine on it. The switch activator may be a cover, which in its closed position prevents light from reaching the photo collecting portion and in this state the switch is open so that no current flows to the motor. When the cover is in its opened position, light, if present, will impinge the light collecting portion. This closes the light activated switch, that is, completes the electrical circuit so that current flows from the power source to the motor. Many arrangements of the switch, handle and reservoir are possible and will be apparent to a person of ordinary skill in the pertinent art. Furthermore, it may be preferable to have more than one on-off means in a single applicator. A first means could be an automatic switch and a second means could be a manual switch, as just described. These could be wired to operate as a so-called "three-way" switch, giving the user the option of over-riding the automatic switch.

In a preferred embodiment of the present invention, the vibration means is reusable. A reusable vibration means is achieved by making the eyelash applicator head detachable so that it can be replaced with another head. By making the applicator head detachable, the vibration means (for example, electric motor) can be reused indefinitely, with the same type of mascara or different mascara and with the same type of brush head or different brush head. The vibration means is likely to be the most expensive part of the applicator, so its reusability is a real advantage. There are other advantages also. For example, when a user exhausts the mascara in a reservoir, she only has to dispose of the reservoir and the applicator head, while reusing the vibration means. Therefore, there is less waste if the vibration means is reusable. If the user wishes to continue using the same mascara formulation, then she may keep the applicator head, but may want to change it, if the head has become dirty or defective. On the other hand, if the user wishes to change mascara compositions, then the user will also want to change applicator heads so as not to contaminate the new composition. This is a real benefit over prior art applicators that do not allow the user to change the applicator head. Furthermore, even if a user is not changing mascara formulations, she may wish to try a new style of applicator head to optimize results. As discussed, many variations of mascara applicators have been devised for their performance benefits. The detachable applicator head feature of the present invention allows virtually any style applicator head to be used as a vibrating applicator for additional performance benefits.

The detachable applicator head feature may be affected by any suitable means that renders the vibration means reusable. For example, the rod 2*b* may be detachably attached to the stem 2*a* or the stem to the handle 1. Alternatively, the applicator head 3 may be detachably attached to the rod. Here, it is assumed that the vibration means is housed in the handle. A detachable attachment can be obtained by friction fitting or snap fitting part of the rod into part of the stem or vice versa or friction/snap fitting part of the stem into the handle. Alternatively, these parts may be joined by cooperating screw threads or lugs. Many suitable configurations will be apparent to those skilled in the art.

The present invention also encompasses a mascara makeup kit comprising more than one reservoir, each reservoir containing a mascara composition, wherein the compositions are not all the same. For example, a mascara makeup kit may comprise five reservoirs, each reservoir containing a different shade of mascara. Such a kit also includes a suitable number of eyelash applicator heads, at least one associated with each different composition. In such a kit, there only needs to be one reusable vibrating means because the user may change the applicator head as needed.

The present invention also encompasses a mascara makeup kit comprising more than one style of applicator head, each head providing a different performance benefit. For example, there may be one brush with relatively stiff bristles and one with relatively soft bristles; a brush with dense bristle distribution and a brush with mixed fiber types; a traditional spiral brush and a so-called button-hole brush; brushes with bristles and brushes with beads or discs, etc. The kit may also contain more than one of the same applicator if there is a need to replace a particular type of applicator. The combinations are unlimited. In such a kit, there only needs to be one reusable vibrating means because the user may change the applicator head as needed.

In one working embodiment of the present invention, significant results were achieved with an amplitude of about 0.0625 inches and a frequency of about 50 cycles per second. More generally, a useful range of vibrational frequency is expected to be from about 10 to about 1000 cycles per second. However, miniature motors seem to be readily commercially available up to about 300 cycles per second. Because it may be difficult at present to manufacture or obtain miniature motors beyond about 300 cycles per second, a range of 10 to 300 cycles per second is preferred, 30 to 100 most preferred. A useful range of vibrational amplitude is about one sixty-fourth (0.016) to about one quarter (0.250) of an inch. Beyond this, the motion of the brush may be distracting to the user and the product reservoir may be too small to allow a larger movement. Less than this may be difficult to achieve in the simple design set forth here. One thirty-second to one eighth of an inch is preferred and about one-sixteenth of an inch is most preferred. An amplitude of one sixteenth is sufficient to shear the product while not being too distracting to the user. These useful ranges of frequency and amplitude are significantly different from those disclosed in known personal care vibrational devices, such as, for example U.S. Pat. No. 5,299,354 for the oscillating shaver, discussed above. For reasons not apparent in the '354 patent, an oscillating blade drawn across the skin has the disclosed amplitude of 0.002 to 0.007 inches, compared to 0.016 to 0.250 inches of the present invention. Also, the motor frequency of the oscillating shaver is disclosed as being 5000 to 6500 rpm, compared to a preferred range of 600 to 18000 for the present invention. Of course, in the present invention the vibrational values of the oscillating brush are adapted to alter the viscosity of a mascara. In contrast, the vibrational values of the oscillating shaver are presumably selected to optimize raising the facial hair.

In altering the viscosity of a mascara, the frequency and amplitude of the vibrating brush are not the only factors to consider. Another is the configuration or geometry of the applicator tip. Parameters such as, total surface area that is in contact with the mascara and shape of those surfaces, also determine of how the viscosity of a mascara will react. Therefore, at a given frequency and amplitude, different applicator types will yield different results, some more beneficial than others. Routine experimentation can be used to arrive at the desired results. In general, more alteration of the mascara viscosity is expected as the surface area of the portion of the applicator that is in contact with product increases. Generally, a more irregular applicator surface is expected to have a greater effect on the viscosity.

Effect of the Applicator on Mascara

In this section, it will be shown that a vibrating brush according to the present invention can have a persisting effect on the rheology of a mascara. Generally, fluid flow properties, like viscosity, depend on three factors: temperature, rate of applied shear, and time of applied shear. Heating a mascara to alter its flow properties, as in the '344 patent, is fundamentally different from the present invention which relies on shearing the product and wherein the temperature remains substantially constant. Not only do heating and shearing alter the viscosity of a given material by different molecular mechanisms, but the behaviors of the material after the heating or shearing is removed are different from one another, so the two methods of altering the viscosity are not the same. Of particular interest in this application is the behavior of mascara when sheared with a vibrating brush for a defined period and in the minutes after the shearing is abruptly removed. Standard definitions of rheological terms are somewhat application dependent, but those found in the following reference may be useful to the reader: "Guide To Rheological Nomenclature: Measurements In Ceramic Particulate Systems;" National Institutes of Standards and Technology Special Publication 946, January 2001; herein, incorporated by reference.

Figure 7A:
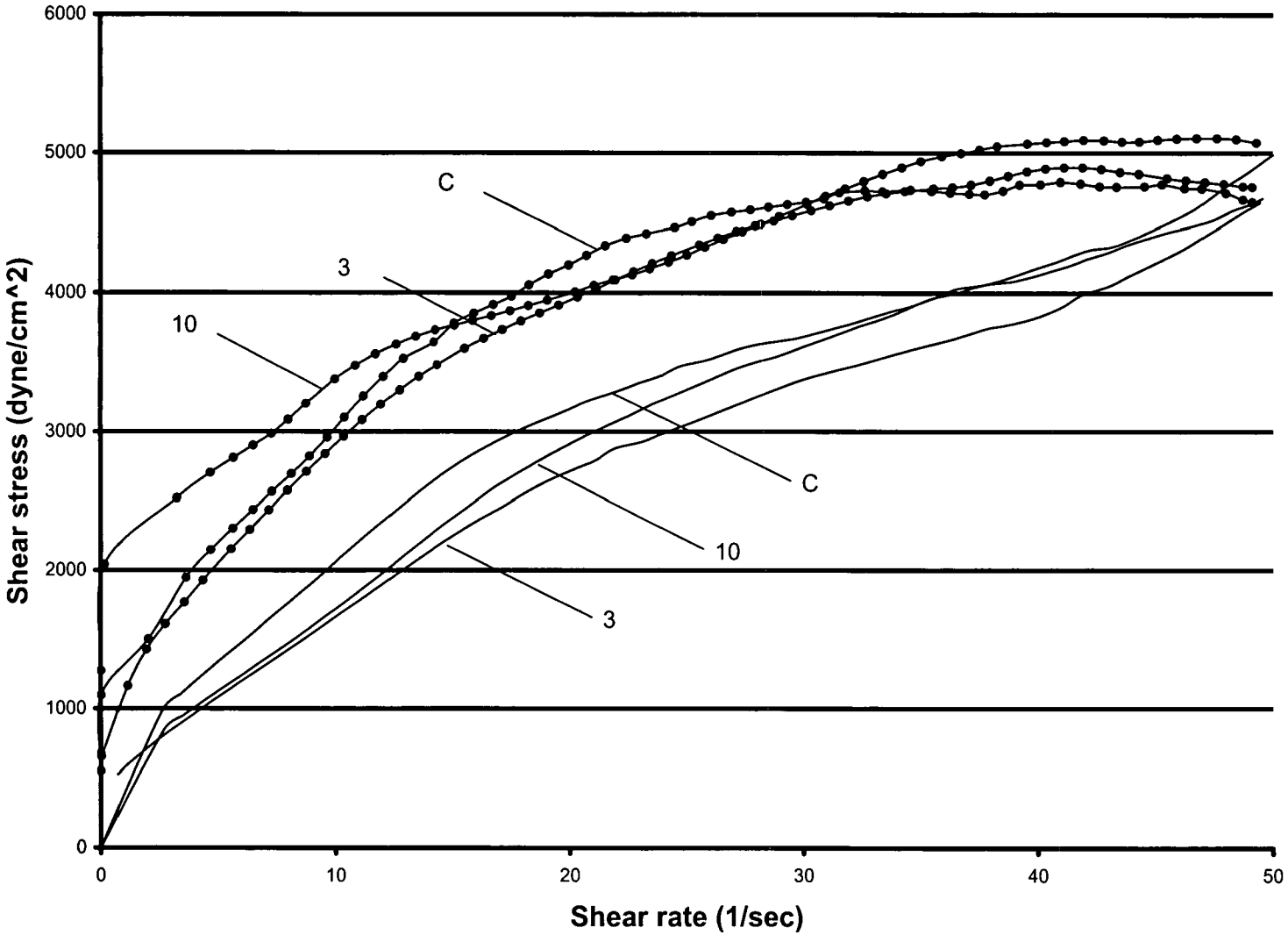
FIG. 7 is a hysteresis loop generated in a standard rhoemetric test of a thixotropic mascara.

FIGS. 7*a* and *b* and 8*a* and *b* are graphs of measurements made during two standard rheometric tests for each of two mascara compositions. These are variable rate shear tests that characterize the behavior of a material over a range of applied shear. The rate of applied shear is shown on the horizontal axis and the stress induced in the test material is shown on the vertical axis. Starting from zero, shear is increased over a defined range, either 0 to 50 or 0 to 1000 $sec^{-1}$, in these tests. As the shear increases, so too does the stress in the sample, recorded in the graph as dynes per centimeter square. When the upper limit shear rate has been reached, the rate of shear is decreased in a controlled manner back to zero and the stress measured along the way. The entire test may take as little as two minutes. In the graphs, dotted curves (or "up curves") represent the induced stress as shear is being ramped up and un-dotted curves (or "down curves") track the stress as the shear is being ramped down. Each graph shows three test samples: a control (labeled "C"); a sample that had been pre-sheared for three minutes with a vibrating brush according to the present invention, (labeled 3); a sample that had been pre-sheared for ten minutes with a vibrating brush according to the present invention, (labeled 10). The pre-sheared samples were tested within two or five minutes after the pre-shearing step.

These measurements were conducted at ambient conditions using a standard parallel steel plate geometry, the plate having a diameter of 2.0 cm and a 200 micron gap. The test duration was 2.0 minutes, one minute ramping the shear up and one minute ramping the shear down. On graphs 7*a* and 8*a*, the initial shear was 0 $sec^{-1}$ and the maximum was 50 $sec^{-1}$ (the low shear test). On graphs 7*b* and 8*b*, the initial shear was 0 $sec^{-1}$ and the maximum was 1000 $sec^{-1}$ (the high shear test). The ramp mode was linear and continuous. The vibrating applicator used to pre-shear the samples was a twisted wire core bristle brush applicator, having a vibrational frequency of 50 cycles per second, constructed according to the present invention.

In the graphs, the fact that the down curve does not exactly retrace the up curve is indicative of so-called "thixotropic" or "anti-thixotropic" behavior, the area between the curves providing a measurement of the degree of either. In such a plot, ranges of shear where the up curve lies above the down curve indicate thixotropic behavior while ranges of shear where the down curve lies above the up curve indicate anti-thixotropic behavior. The mascara of FIGS. 7*a* and 7*b* behaves thixotropically over the whole test range in both tests of all three samples. The mascara of FIG. 8*a* exhibits anti-thixotropic behavior above a shear rate of about 20 to 25 $sec^{-1}$. This anti-thixotropic behavior continues on to about 600 $sec^{-1}$ in graph 8*b*. Outside of either of these regions the mascara is behaving thixotropically.

It is crucial to realize that the test samples that were pre-sheared with a vibrating brush (those labeled 3 and 10) performed differently than the control sample (labeled C). This is true even though the pre-sheared samples were not measured until two to five minutes after being pre-sheared. This means that the vibrating brush has a persisting effect on the rheology (i.e. viscosity) of the mascara composition. That the vibrating brush is effective to alter the rheology of mascara can be seen from Tables 1 and 2. The average applied stress is the stress required to deform (shear) the mascara, being averaged over the shear rate range 100 to 900 $sec^{-1}$. This value was derived from the data of FIGS. 7*b* and 8*b* for the control, and the three and ten minute pre-sheared samples. Percent changes verses the controls are shown.

TABLE 1

Figure 7B:
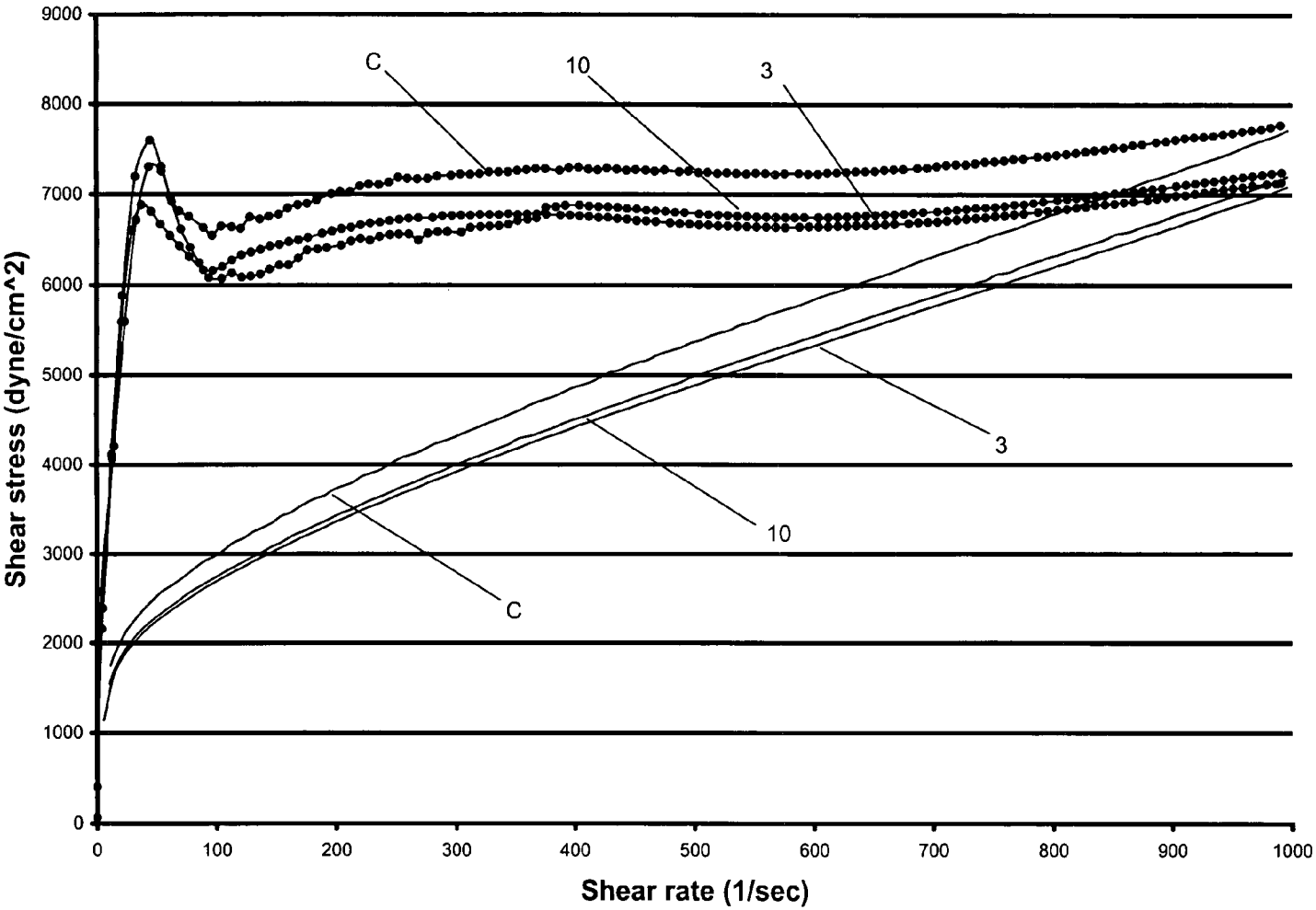
Figure 8A:
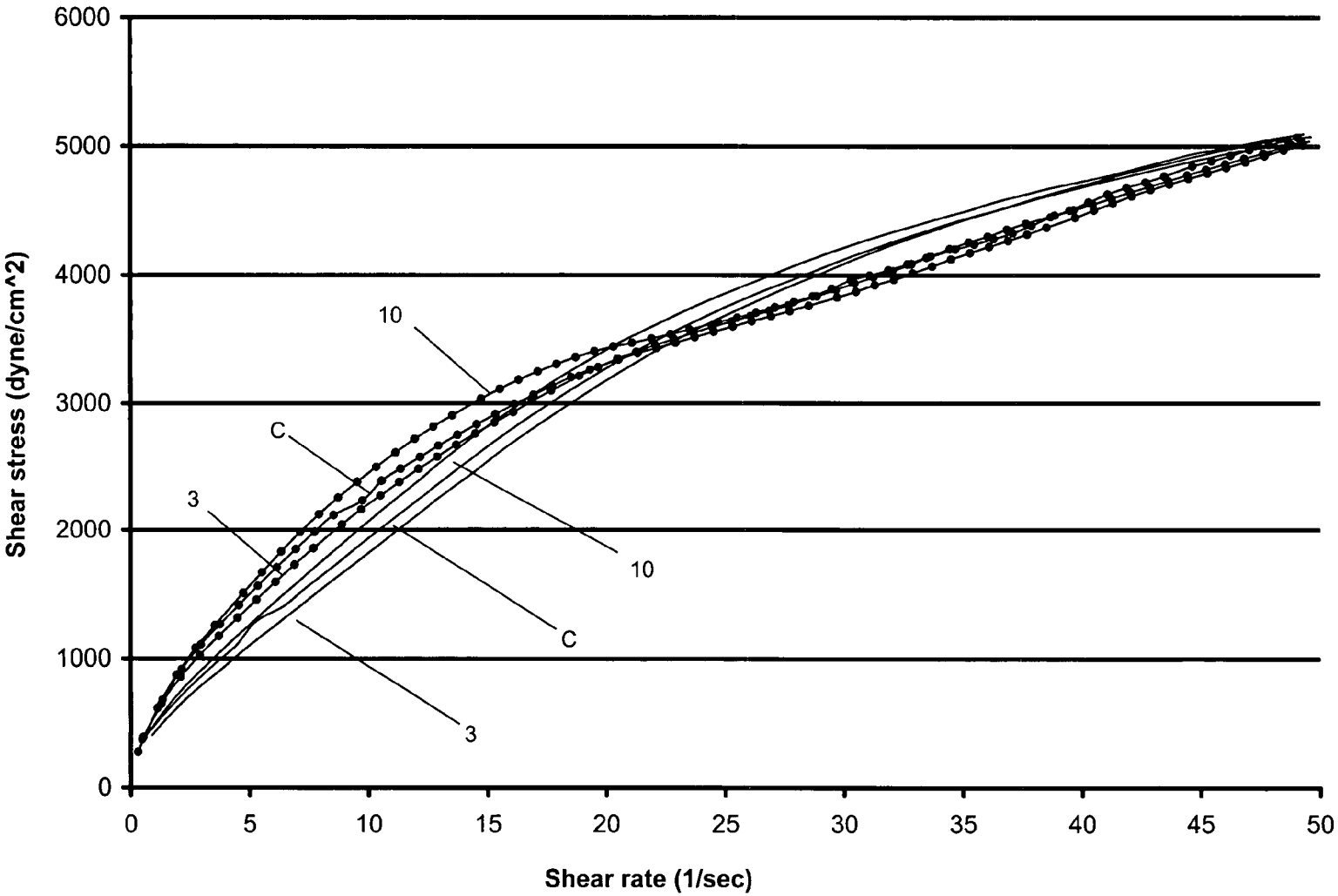
FIG. 8 is a hysteresis loop of an anti-thixotropic mascara.

| Data from test sample of FIG. 7b | % change of average applied stress vs. control |
|---|---|
| 3 min vibration | −7.30% |
| 10 min vibration | −6.71% |

TABLE 2

Figure 8B:
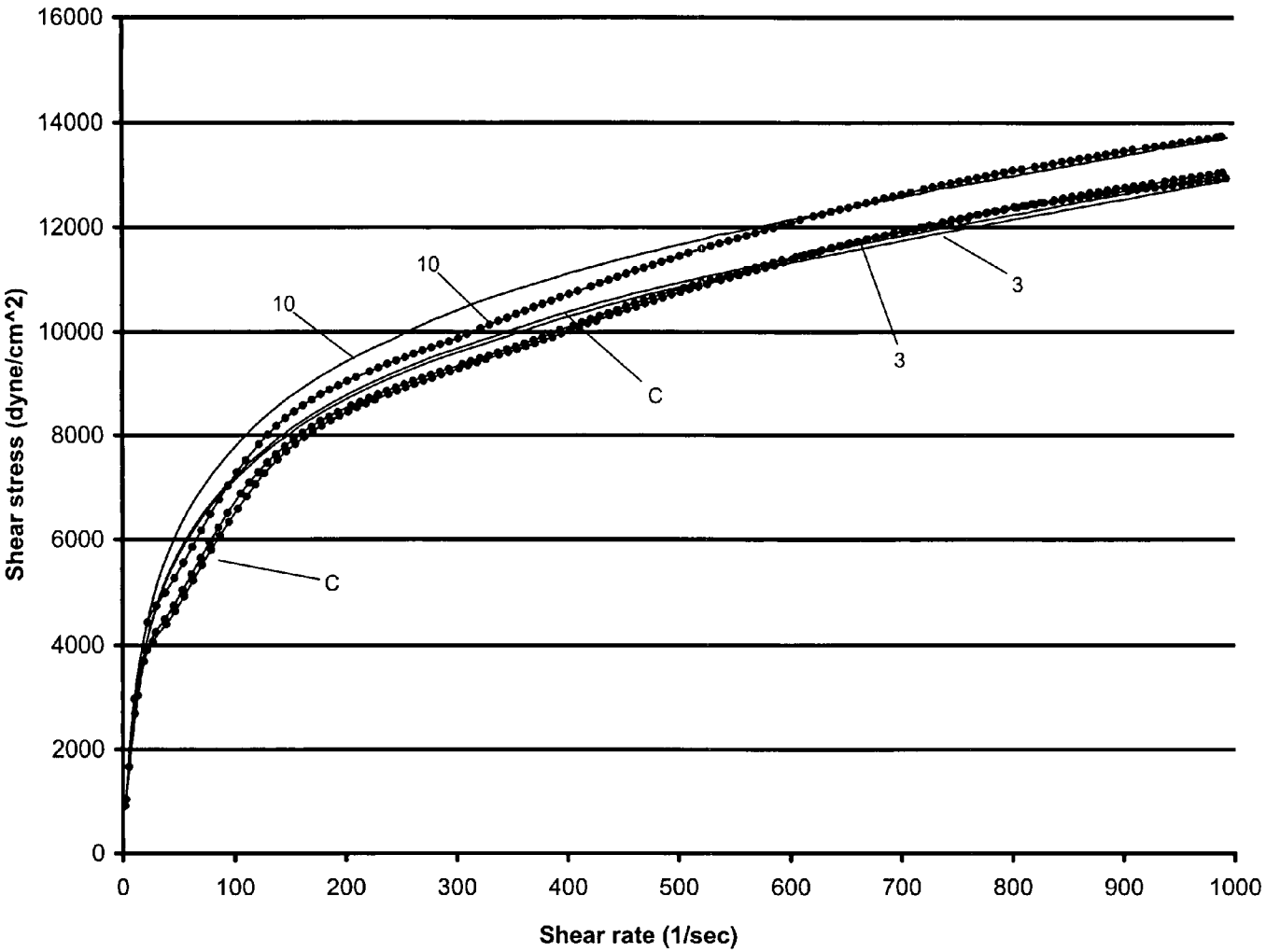

| Data from test sample of FIG. 8b | % change of average applied stress vs. control |
|---|---|
| 3 min vibration | 0.70% |
| 10 min vibration | 6.49% |

Table 1, corresponding to FIG. 7*b*, shows that, compared to the control, less stress was required to deform (shear) the pre-sheared mascara. In other words, the vibrating brush lowered the viscosity of the mascara and this lowered viscosity persisted for at least two to five minutes after the brush was removed. Table 2, corresponding to FIG. 8*b* shows that on average, compared to the control, more stress was required to deform (shear) the pre-sheared mascara. In other words, the vibrating brush increased the viscosity of the mascara and this increased viscosity persisted for at least two to five minutes after the brush was removed.

Tables 3 and 4 make this point again. The data in these tables is again taken from the tests represented in FIGS. 7 and 8, respectively. The tables list the viscosity of the mascara at selected rates of shear, during the test, as the shear was being ramped up and as the shear was being ramped down. In Table 3, we see the control go from a viscosity of about 64 poise at 100 $sec^{-1}$ shear rate, down to about 8 poise at 900 $sec^{-1}$ shear rate, then back up to about 29 poise at 100 $sec^{-1}$. The mascara has been thinned considerably by the test. The same pattern can be seen for the three and ten minute samples, however, and very importantly, the whole range of viscosity has shifted down as a result of the pre-shearing by the vibrating brush. It should be remembered that the pre-sheared samples sat for two to five minutes prior to running the rheology test, during which time the viscosity is re-building although clearly, the viscosity remains significantly below the control value by the start of the test. In other words, the thinning effect of the vibrating brush persists for more than two to five minutes. To the best of the applicant's knowledge, no such or similar persisting effect has ever been reported.

TABLE 3

| | Viscosity (poise) @ 100 1/sec | Viscosity (poise) @ 400 1/sec | Viscosity (poise) @ 900 1/sec |
|---|---|---|---|
| Viscosity reading (during ramp up) | | | |
| control | 64.24 | 18.09 | 8.424 |
| 3 min vibration | 59.24 | 16.74 | 7.736 |
| 10 min vibration | 58.27 | 17.03 | 7.853 |
| Viscosity reading (during ramp down) | | | |
| control | 28.66 | 12.05 | 8.021 |
| 3 min vibration | 25.95 | 10.99 | 7.360 |
| 10 min vibration | 26.47 | 11.19 | 7.498 |

In Table 4, we see the control go from a viscosity of about 64 poise at 100 $sec^{-1}$ shear rate, down to about 14 poise at 900 $sec^{-1}$ shear rate, then up to about 71 poise at 100 $sec^{-1}$ shear, which is greater than its viscosity at 100 $sec^{-1}$ shear rate on the ramp up. Therefore, this mascara has been thickened considerably by the rheology test. The same pattern can be seen for the three and ten minute samples, although for the most part the whole range of viscosity has shifted up, meaning that pre-shearing with a vibrating brush also thickened the mascara. It should be remembered that the pre-sheared samples sat for two to five minutes prior to running the rheology test, which shows that the thickening effect of the vibrating brush persists for more than two to five minutes.

TABLE 4

| | Viscosity (poise) @ 100 1/sec | Viscosity (poise) @ 400 1/sec | Viscosity (poise) @ 900 1/sec |
|---|---|---|---|
| Viscosity reading (during ramp up) | | | |
| control | 64.07 | 24.91 | 14.15 |
| 3 min vibration | 65.20 | 24.97 | 14.04 |
| 10 min vibration | 71.40 | 26.69 | 14.94 |
| Viscosity reading (during ramp down) | | | |
| control | 70.88 | 25.85 | 14.03 |
| 3 min vibration | 69.74 | 25.56 | 13.89 |
| 10 min vibration | 75.82 | 27.61 | 14.84 |

These tables are important because they show that a vibrating brush according to the present invention has a persisting effect on the mascara that is measurable over a wide range of applied shear, meaning that the effect is pronounced and therefore usable. Whether the overall effect of the vibrating applicator is to decrease or increase the viscosity, depends, in part, on the composition of the mascara.

The rheometric tests just described show that a vibrating brush according to the present invention may have a persisting effect on the rheology of a mascara. However, the actual response of any given mascara to a vibrating brush according to the present invention is generally, quite complex due to the fact that a vibrating applicator according to the present invention oscillates, changing speed and direction continuously as it shears the mascara. The response of the mascara depends on the amount of shearing energy transferred to the mascara, which depends in part on the amplitude and frequency of the brush, the brush geometry and the path that the brush takes through the mascara, the duration of vibration, as well as the surface area of the vibrating applicator head in contact with product. It should also be noted that the mascara product continues to be sheared during application to the eyelashes. As the vibrating brush is being drawn between the eyelashes, the portion of mascara that is in contact with both the brush and the eyelash, is subject to shearing forces. The layers of mascara closest to a lash remain motionless while the layers further away are drawn by the vibrating brush. This situation is quite irregular and complex. In contrast, rheological terms like "thixotropy" and "anti-thixotropy" are defined for constant shear rate situations, while "shear thinning" is defined in relation steadily increasing shear occurring in one direction only. Generally, these types of controlled flow conditions are not created by a vibrating applicator of the present invention. However, like a thixotropic response, it is likely that loss of viscosity is due, in part to the molecular structure arranging itself into a network that is less firm than the network of the undisturbed material. Similarly, like an anti-thixotropic response, it is likely that an increase in viscosity is due to the molecular structure arranging itself into a network that is firmer than the network of the undisturbed material. Furthermore, it is expected that the persisting rheological effect would not last indefinitely, due to the new molecular structure of the mascara reversing itself (or relaxing) while the energy of shear is being dissipated as heat. Nevertheless, the foregoing discussion demonstrates the surprising result, that the effect of a vibrating brush according to the present invention may last long enough to allow a user to effectively manipulate a mascara at the time of application, to change the rheology of the mascara, to yield a benefit, in fact, many benefits.

Throughout the specification, "thixotropic mascara" means a mascara whose overall response to a vibrating applicator is to lose viscosity, the lose of viscosity persisting for a substantial period of time after the vibration has stopped. The substantial period is long enough for a user to fully apply the mascara in a prescribed manner, say, at least about two to five minutes. Furthermore, the lose of viscosity is self-reversible after the substantial period. Throughout the specification, "anti-thixotropic mascara" means a mascara whose overall response to a vibrating applicator is to gain viscosity, the gain in viscosity persisting for a substantial period of time after the vibration has stopped. The substantial period is long enough for a user to fully apply the mascara in a prescribed manner, say, at least about two to five minutes. Furthermore, the gain in viscosity is self-reversible after the substantial period.

For mascara, "initial viscosity" means the viscosity that an unsheared mascara has in a closed container (no loss of volatile components). Starting in an undisturbed (un-sheared) state, characterized by an initial viscosity, the overall response of a thixotropic mascara to a vibrating applicator is a lose of viscosity. When the applied shear is abruptly removed, the viscosity of a thixotropic mascara will build back up, over time, to a final value that is substantially near its initial value, unless some other mechanism intervenes. Regarding an anti-thixotropic mascara, its overall response to a vibrating applicator is a gain of viscosity. However, an increase in viscosity may not occur right away, as the anti-thixotropic response of any material generally depends on the shear history of a material. Rather, the first response of even an anti-thixotropic mascara (as defined above), may be to lose viscosity. Sometime after this initial response, with additional shearing, a build up of viscosity begins, as a new molecular ordering takes shape. Because the anti-thixotropic behavior may not manifest right away, it may be necessary to instruct a user to pre-vibrate the mascara for a prescribed time before applying to the lashes, but the prescribed time depends on the actual composition. At any rate, after an increase in viscosity and after the applied shear has been removed, the viscosity of an anti-thixotropic mascara will drop, over time, to a final value that is substantially near its initial value, unless some other mechanism intervenes. What is advantageous and wholly unknown prior to this disclosure, is that the observed duration of the persisting rheological effect is long enough to afford an opportunity to interrupt the self-reversing relaxation of the sheared mascara, so that the final viscosity of the mascara may be substantially different from its initial viscosity. In the same manner, it is also possible that other rheological properties may achieve final values that are different from their initial values. In this way, it is provide a customer with a mascara whose rheological properties are similar to known mascaras with the intent of permanently altering one or more of those properties during application. Or, it is possible to provide a customer with a mascara having unconventional rheological properties with the intent of altering those properties to have more conventional values after application.

Controlling the Persisting Rheological Effect

After the shear has been removed, the viscosity of a sheared mascara will generally return to near its initial viscosity, unless some other mechanism intervenes. The mechanism of the present invention is the relatively rapid loss of solvents that volatilize off the mascara at ambient conditions. Generally, a loss of volatile solvents from mascara tends to thicken the mascara and increase the mascara's viscosity. Therefore, there is a period of time following the application of the mascara to the lashes, after the applied shear has been removed, wherein the viscosity of the applied mascara is being affected by two phenomena; loss of solvent and structural molecular changes appropriate to sheared thixotropic or anti-thixotropic mascaras. In the case of a thixotropic mascara, the loss of solvent and the structural changes both operate to increase the viscosity of the product. In the case of anti-thixotropic mascara, the loss of solvent works to increase the viscosity of the product while structural changes operate to decrease the viscosity. Because of these competing or complementing effects, the mascara may become fixed at a sheared final viscosity that is different from its unsheared final viscosity. "Sheared final viscosity" is the viscosity of the applied mascara after shearing with a vibrating brush and after all solvent loss. "Unsheared final viscosity" is the viscosity that the applied mascara would have if not sheared according to the present invention, but after all solvents have volatilized from the mascara.

For the first time, it has been observed that the loss of solvent can be used to control the sheared final viscosity by adjusting the time for solvent loss compared to the time of the persisting rheological effect caused by shearing with a vibrating brush. "Persisting rheological effect" means that the rheological effect lasts long enough so that the sheared final viscosity depends on the rate of solvent loss. In other words, the rheological effect does not reverse itself so fast, that the choice of solvents becomes immaterial. The time for solvent loss may be adjusted by controlling the ratio of fast to slow volatizing liquids in the composition or the ratio of volatiles to solids in the composition. Generally, the more solvent in the formula, the more time there will be for the persisting rheological effect to reverse, and vice versa. In different situations it will be beneficial for the persisting effect to be of longer or shorter duration.

The principle advantage to this system is the ability to have it both ways, so to speak. For example, a user may be supplied with a mascara system that, because of the reduced viscosity during shearing, flows more easily onto the lashes, providing a smoother, easier application of more product with good separation and decreased clumping, while on the other hand fullness and overall look do not suffer because sufficient time is allotted for the viscosity to rebuild to a beneficial level. In another example, a user is supplied with a mascara which initial viscosity is lower than usual, but which viscosity is increased at the time of application by a vibrating brush. Following application, the viscosity is not allowed to substantially relax due to a rapid loss of solvent. The benefits of formulating thinner mascaras accrue in manufacturing. As mentioned, because mascaras are so thick and difficult to handle any reduction in viscosity during manufacture saves energy and costs. Other examples will be readily apparent to those skilled in the art. In developing a combination mascara and vibrating brush system, what is crucial is some idea of the response of the mascara to a vibrating brush. Of course, the developer always has the option of instructing a user when to use vibration and when not to use it. Generally, vibration may used throughout application, while the applicator is in the reservoir and on the lashes, or vibration may be employed only in the reservoir or only on the lashes. The developer is free to choose this based on the response of the mascara to the vibrating brush. Therefore, the present invention also encompasses a kit that comprises instructions for use of a vibrating mascara brush.

One general application of these principles could be stated this way. Say a developer wants to create a mascara composition with decreased lash clumping compared to some pre-final version of the mascara. Conventionally, a developer may increase the level of liquids that evaporate relatively slowly, thereby keeping the mascara wetter and more flowable. A disadvantage of doing this is that it tends to increase smudging of the composition and transfer to another surface, because the product viscosity remains lower for a longer period of time, perhaps well after the application is finished. Alternatively, according to the present invention a developer could keep a lower level of slowly evaporating liquids, while making the formula sufficiently thixotropic so that an appropriately selected vibrating applicator will temporarily reduce viscosity which will reduce clumping during application. After application, when the sheared mascara is on the lashes with no clumping, the viscosity of the mascara builds for two reasons: the molecular restructuring associated with thixotropic fluids and the loss of rapidly evaporating fluids from the composition. Which one contributes more to thickening depends on the level of solvent loss and on the degree of shearing. Here is another, new advantage for the developer. If the solvents volatilize quickly enough, the molecular restructuring may not be completed before the mascara sets up. Therefore, it may be possible that the sheared final viscosity of the applied mascara will be lower than its unsheared final viscosity, but still within acceptable parameters. On the other hand, if the solvent volatilizes slowly enough, the restructuring may be substantially completed and then further loss of solvent will complete the thickening, so that the sheared final viscosity may be substantially the same as the unsheared final viscosity. This molecular restructuring of the mascara on the lashes thickens the mascara and makes it less susceptible to smudging. Thus, the developer has supplied the customer with a better product as far as ease of application and clumping are concerned, without increasing smudge or transfer.

Another general application of these principles could be stated this way. Say a developer has a pre-final version of a product, but wants to increase the levels of fullness, thickness, and lengthening of the product. Typically, a developer may want to incorporate a high level of solids into the formula, to give added structure and fullness to the mascara. The drawbacks of doing this include increased costs and complexity associated with manufacture and filling. The drawbacks may be sufficient to render mass production of the product unfeasible. This may force a developer to compromise the formula. In contrast, according to the present invention, the developer may keep the level of solids relatively low, while intentionally making the mascara sufficiently anti-thixotropic. "Sufficiently anti-thixotropic" means that an appropriately selected vibrating brush used in the manner described herein, will impart added molecular structure to the mascara. After the application, the solvent system has been designed so that loss of solvent occurs more quickly than loss of the added molecular structure. The relatively rapid loss of solvent prevents the firmer molecular network from completely deteriorating. The result is that the applied mascara sets up with more structure (i.e. is thicker) than if a vibrating applicator had not been used. Thus the developer has achieved a mascara having good fullness, thickness and length, that is practical to mass produce.

The combination of a mascara and an effective vibrating brush is unknown in the prior art. "Effective vibrating brush" means a brush that is effective to alter the viscosity of a mascara in a predictable way, including having a persisting, measurable effect on the viscosity of the mascara. Identifying the parameters of an effective vibrating brush is a straightforward process. Using standard rheological measurement equipment, as described above, flow charts may be generated for a control sample and for samples that were pre-sheared with a vibrating brush within a known time prior to the flow test. The degree of shifting of the up and down pre-sheared curves away from the control curves is indicative of the degree of effect that the vibrating brush is having on the mascara. The difference in area between the up and down flow curves of pre-sheared samples and the control sample indicates whether the brush is making the mascara more or less thixotropic or more or less anti-thixotropic. If little or no effect is observed, various brush parameters may be altered and the tests repeated until an effective brush is identified.

Armed with this knowledge, a developer may by routine experimentation arrive at a level of volatiles and a rate of volatile loss that supports the desired mascara performance, as described above. More generally, having concocted a pre-final mascara composition, the developer will obtain stress verses applied shear flow curves like FIG. 7 or 8. The vibrating brush used to pre-shear the test samples may be chosen by any of several methods. For example, if there is no prior experience or expectation of mascara response, then an arbitrary brush geometry may be used. Alternatively, a manufacturer may want to sell the mascara with a commercially successful brush. Alternatively, based on experience, the developer may already have a good idea of where to start. After obtaining the flow curves, the degree of any rheological effect may be inferred from the shifting of the pre-sheared curves away from the control curves. The minimum time that any rheological effect persists may be inferred from the time between pre-shear and actual measurements. Based on this information, the developer may change the brush parameters and run the flow tests again. Brush parameters include physical dimensions, material properties, vibrational frequency and amplitude. Physical dimensions include shape of the envelope, bristle length and density. Material properties include stiffness, surface treatment, slip characteristics. By adjusting any of these, an effective brush is identified through routine experimentation. At some point, when the rheological effect is sufficiently pronounced and of sufficient duration, the developer may settle on specific brush parameters. From there, the vibrating brush may put to actual use in applying mascara to the lashes. BY doing so, opportunities for further improvements in performance may be noted. Finally, the pre-final mascara composition will be reformulated by adjusting the levels and types of volatiles in the composition to support or hinder the amount of molecular restructuring that is allowed to take place. Thus, the rheology plots described herein become an powerful tool during the formulation of mascaras to be used with a vibrating brush. The rheology plots are a tool for suggesting what are the parameters of an effective vibrating brush. In one working embodiment of the present invention, significant results were achieved with an amplitude of about 0.0625 inches and a frequency of about 50 cycles per second or 3000 cycles per minute. These results were discussed above and they show a persisting effect on the viscosity, the effect lasting at least two to five minutes.

Additional Benefits

Apart from the rheologic benefits already described, the vibrating applicator of the present invention provides significant advantages over the prior art. An applicator head that is vibrating in the product reservoir generally picks up more product than when it is not vibrating in the reservoir. This is advantageous, because often mascara applicators suffer from not being able to retrieve in one shot, an amount of mascara necessary to make up one eye. The reason for this may depend on the nature of the mascara formulation; more viscous mascaras are more difficult to accumulate on a bristle head. Or, it may depend on the brush itself or on the wiper. As noted above, brushes with more flexible bristles tend to pick up less mascara than equivalent brushes with stiffer bristles. It also depends on the amount of product remaining in the reservoir. A conventional brush is fully inserted into the reservoir when the handle is completely screwed down on the neck. In this position, a conventional brush cannot move, for example, side to side to find mascara. Even the rotating brushes described above do not reach any further to the sides of the container than a stationary brush. In contrast, an oscillating brush is able to reach more product, product closer to the walls of the container. Therefore, by providing an applicator head that vibrates side to side, the present invention offers an entirely new way to increase the amount of product retrieved in one trip to the reservoir. A related issue, is the inability to evacuate all of the contents of the reservoir. In a typical mascara applicator-bottle combination, a significant amount of unusable product remains in reservoir, stuck to the interior walls of the reservoir, because the applicator head is unable to reach it. An applicator head that is vibrating perpendicularly to the long axis of the rod 2*b*, in the product reservoir, helps lift mascara from the interior surfaces of the reservoir. Therefore, by providing an applicator head that vibrates side to side, the present invention offers an entirely new way to increase the amount of product evacuated from the reservoir. Even a mascara brush that rotates, as described above, will not increase evacuation of the reservoir any better than a stationary brush. But the side-to-side motion of the vibrating brush will cause the brush to reach more product. Some of the foregoing benefits may also be realized by providing an effective degree of vibration to the reservoir. The reservoir will vibrate if a vibrating applicator is in contact with the reservoir, but it may also be advantageous to provide a separate vibrating means for the reservoir.

The present invention is not limited by any one particular type oscillatory motion of the applicator head. One type of oscillatory motion is a simple back and forth or simple side to side motion, perpendicular to the axis of the rod 2*b*. More complex side to side motions are possible and may be useful. Motions characterized by saying that the tip of the applicator head traces out a closed path, like a circle, ellipse or figure eight are examples of more complex side to side motions that are encompassed by the present invention. In a preferred embodiment of the present invention the vibratory movement of the applicator head is a simple back and forth motion, perpendicular to the axis of the rod, the motion of the rod being approximately confined to a plane. Starting from its resting position, the head deflects to the right, for example, reaches the end of its travel (or full amplitude), reverses direction and travels along the same path back through the resting position and continues up to its full amplitude to the left. In this embodiment, the oscillatory movement of the brush relative to the eyelashes depends on the orientation of the brush, which orientation is controlled by the user. The user may hold the brush such that the brush head is moving in an approximately vertical plane or in an approximately horizontal plane. In the latter case, the brush head oscillates toward and away from the base of the eyelash or toward and away from the face of the user. This may also be described as saying that the oscillatory motion of the applicator head is approximately parallel to the length of the eyelashes. This situation may be particularly effective for ensuring that the full length of the lashes are evenly coated with mascara, even close to the eyelid (or base of the lash) where applying mascara has always been especially difficult. For example, the vibrating movement of the brush head naturally carries and pushes the mascara toward the baseline of the eyelash. Also, the back and forth motion of the applicator head distributes the product over the length of the lashes more evenly than can be achieved with a conventional applicator. This is because the oscillating brush moves over each segment of a lash many more times than a conventional brush. With each oscillation, the mascara is spread and smoothed out to give highly uniform coating along the length of the lashes.

The handle of the applicator may advantageously comprise a means of communicating to the user, what is the direction of oscillation of the brush head. Because the direction of the brush head oscillation it may not be easily discernible, some means for informing the user may be provided. One means comprises indicia (inscribed, etched, printed, etc.) located on the handle that indicates to the user the direction of motion of the brush head. An alternate means may be to provide a contoured surface on the handle, such as a molded grip, that directs the user to grasp the applicator in such a way that the brush head motion will be horizontal when the applicator is raised to the eye. Other such means will be obvious to a person of ordinary skill in the art. Optionally, the handle of the applicator may be provided with a grip that absorbs some or substantially all of the vibration, such that a user does not perceive the vibration in her hand. This may be desirable to the extent that any vibration felt in the hand of a user is unpleasant or a distraction during application. A soft rubber grip or gel-filled grip are examples grips that are suitable for this purpose.

In addition to the advantages already mentioned, an applicator of the present invention gives to the user an ability to vary the performance properties of the brush unlike anything in the prior art. As earlier discussed, the application of mascara is a multi-step process. Ideally, at different steps in the process the applicator would exhibit different properties. The ability of the user to turn the vibration on and off affords just this opportunity. When the applicator head is in the reservoir, the amount of product loaded onto the brush depends on whether the applicator head is vibrating or not. The user may turn the motor on or off as more or less product loading is desired. No prior mascara applicator offers this choice. Also, when drawing the applicator head through the wiper, the amount of product that will remain on the applicator head and the degree to which the product is spread evenly over the applicator head will depend on whether the head is vibrating or not and at with what frequency. Generally, more product will be wiped off the head if the head is vibrating, on the other hand, the vibration will cause the product to more evenly coat the applicator head. So again the user may vary the performance of the brush according to her needs. The next step is coating the lashes with mascara. Generally, a vibrating applicator head will deposit more product on the lashes than a non-vibrating one and that is one of the important advantages of the present invention. The vibration will tend to break the adhesion of the mascara to the bristles, simplifying the transfer of the mascara to the lashes. Nevertheless, because the vibration can be selectively controlled, a user may deposit product on a portion of her lashes without the vibration, if desired. Finally, the step of separating lashes that are stuck together by tacky mascara is made significantly easier by a mascara applicator with a vibrating head. The vibration naturally aides in the separating of the lashes. But there again, the vibration may not be needed or desired at all times. The point is, that the an applicator according to the present invention offers a choice and greater flexibility to the user in an easy to applicator. The user has the ability to alter the performance characteristics of the applicator, unlike anything contemplated or suggested by the prior art.

With this additional advantage of being able to alter applicator performance, the mascara manufacturer is also afforded greater flexibility. This benefits the manufacturer and the user. For example, where a highly viscous mascara formulation may have called for an applicator brush having sufficiently stiff bristles to work at all, it should now be possible to use less stiff bristles, the loss of stiffness being made up for by turning on the vibration at the appropriate time. Likewise, a particular reservoir and wiper design or bristle configuration may be suitable for a brush of more flexible bristles. Normally, the manufacturer may be constrained if the flexible bristles are not stiff enough to effectively declump the product and separate the lashes. With the present invention, however, the loss of stiffness could be compensated for by turning on the vibration at the appropriate time. Again, it may be that a situation calls for a brush applicator having stiff bristles. However, the manufacturer is concerned that stiff bristles do not transfer mascara to the lashes as well as soft bristles. Rather than having to offer the public a less than optimal brush, the manufacturer may be able to use the stiff bristles because the vibration will make up for loss of transferability. Many other scenarios in which the advantages of the present invention can be exploited will be readily apparent to a person of ordinary skill in the art.

A vibrating applicator for use with the compositions described herein may be used in a number of ways, as directed by the developer. It may be appropriate to turn on the vibration while the brush is in the reservoir. The developer may or may not suggest letting the vibrating brush remain in the reservoir for an extended period of time prior to using, like three or up to ten minutes for example. Alternatively, the amount of time required for the vibrating brush to have a desired effect may be less than the time it takes to remove the brush from the reservoir. Alternatively, the customer may not turn the brush on while in the reservoir, but only during application on the lashes, if that amount shearing is sufficient for the particular composition and desired effect. Possibly, a user could apply one or more coats of mascara with or without vibration and then apply one or more overcoats without or with vibration, respectively. For example, the base coats could provide thickening and lengthening while the over coat separates and declumps. Alternatively, the lashes may be coated with or without vibration and then a substantially empty brush could be used to groom the lashes without or with vibration, respectively. If multiple frequency settings are provided on the applicator, the developer may recommend one speed for depositing product and a second speed for grooming out the lashes. These are just a few examples of the manner in which vibration and mascara properties may be combined to have a beneficial effect.

What is claimed is:

1. A vibrating mascara applicator comprising:

a handle;

a stem attached to the handle;

a rod attached at its proximal end to the stem and extending beyond the handle;

an eyelash applicator head attached to the distal end of the rod; and a means to vibrate the applicator head, such that the rod flexes in a direction perpendicular to its length when the applicator head is vibrating.

2. The applicator of claim 1 wherein the means to vibrate the eyelash applicator head comprises a DC motor subassembly having an axle, the center of mass of which is offset from its longitudinal axis.

3. The applicator of claim 2 wherein the motor subassembly is housed in the handle of the mascara applicator.

4. The applicator of claim 2 further comprising a DC power supply electrically connected to the motor.

5. The applicator of claim 4 wherein the DC power supply is one or more batteries.

6. The applicator of claim 5 wherein the one or more batteries are located in the handle of the applicator.

7. The applicator of claim 5 wherein the one or more batteries are standard carbon, zinc-carbon, alkaline, lithium, nickel-cadmium, nickel-metal hydride, lithium-ion, zinc-air, zinc-mercury oxide or silver-zinc batteries.

8. The applicator of claim 4 wherein the DC power supply is solar based.

9. The applicator of claim 8 further comprising one or more light collecting portions.

10. The applicator of claim 9 wherein at least some of the one or more light collecting portions are located on the handle of the applicator.

11. The applicator of claim 10 further comprising a cover, which, in a closed position prevents light from reaching the one or more light collecting portions and which, in an opened position allows light to reach the one or more light collecting portions.

12. The applicator of claim 9 further comprising one or more storage cells.

13. An applicator according to claim 2 further comprising one or more means for turning the motor on and off.

14. The applicator of claim 13 wherein at least one of the on/off means is a manual switch that can be engaged, either directly or indirectly, by a finger of the user.

15. The applicator of claim 14 wherein the switch is located on a side wall of the applicator or an end of the handle.

16. The applicator of claim 15 further comprising a cap that secures to the applicator to cover the switch.

17. The applicator of claim 14 wherein the switch is located on the handle and covered by a deformable membrane, such that pressure applied to a portion of the membrane activates the switch.

18. The applicator of claim 14 wherein the switch is a toggle switch, rocker switch, slider, button, rotating knob, touch activation surface, magnetic switch or light activated switch.

19. The applicator of claim 13 wherein the motor is capable of being automatically turned on when the applicator is drawn from a reservoir and capable of being automatically turned off when it is reinserted into the reservoir.

20. The mascara applicator of claim 2 wherein the motor subassembly can change speeds, either stepwise or continuously at the discretion of a user.

21. The mascara applicator of claim 1 wherein the amplitude of brush head vibration is about one sixty-fourth to about one quarter of an inch.

22. The mascara applicator of claim 21 wherein the amplitude of brush head vibration is about one thirty-second to about one eighth of an inch.

23. The mascara applicator of claim 22 wherein the amplitude of brush head vibration is about one sixteenth of an inch.

24. The mascara applicator of claim 1 wherein the frequency of brush head vibration is about 10 to about 1000 cycles per second.

25. The mascara applicator of claim 24 wherein the frequency of brush head vibration is about 10 to about 300 cycles per second.

26. The mascara applicator of claim 25 wherein the frequency of brush head vibration is about 30 to 100 cycles per second.

27. The mascara applicator of claim 1 wherein the means to vibrate the applicator head is reusable.

28. An applicator according to claim 1 that is capable of shearing a mascara such that after the shearing has stopped, a measurable effect on viscosity persists for at least two to five minutes.

* * * * *